US007017569B2

(12) United States Patent
Jong

(10) Patent No.: US 7,017,569 B2
(45) **Date of Patent: *Mar. 28, 2006**

(54) PAINTBALL MARKER LOADER APPARATUS

(76) Inventor: Paul Garfield Jong, 1661 Dennison Street, Markham, Ontario (CA) L3R 0N5

( * ) Notice: Subject to any disclaimer, the term of this patent is extended or adjusted under 35 U.S.C. 154(b) by 0 days.

This patent is subject to a terminal disclaimer.

(21) Appl. No.: 10/689,517

(22) Filed: Oct. 21, 2003

(65) Prior Publication Data

US 2004/0134475 A1 Jul. 15, 2004

Related U.S. Application Data

(63) Continuation-in-part of application No. 09/901,589, filed on Jul. 11, 2001, now Pat. No. 6,644,293.

(51) Int. Cl.
*F41B 11/02* (2006.01)

(52) U.S. Cl. ..... 124/52; 124/51.1

(58) Field of Classification Search ..... 124/45, 124/48, 49, 51.1, 52, 73, 74
See application file for complete search history.

(56) References Cited

U.S. PATENT DOCUMENTS 2,448,081 A * 8/1948 Conway
3,111,121 A 11/1963 Baggott
3,142,294 A 7/1964 Baldwin
5,282,454 A 2/1994 Bell et al.
5,511,333 A 4/1996 Farrell
5,613,483 A 3/1997 Lukas et al.
5,634,456 A 6/1997 Perrone
5,640,945 A 6/1997 Slonaker et al.
5,727,538 A 3/1998 Ellis
5,791,325 A * 8/1998 Anderson
5,794,606 A 8/1998 Deak
5,809,983 A 9/1998 Stonking
5,816,232 A 10/1998 Bell
5,823,173 A 10/1998 Slonaker et al.
5,878,736 A 3/1999 Lotuaco, III
5,881,707 A 3/1999 Gardner, Jr.
5,954,042 A 9/1999 Harvey
5,967,133 A 10/1999 Gardner, Jr.
6,003,504 A 12/1999 Rice et al.
6,035,843 A 3/2000 Smith et al.
6,065,460 A 5/2000 Lotuaco, III (Continued)

FOREIGN PATENT DOCUMENTS

RU 2166721 5/2001

OTHER PUBLICATIONS

Bill Mills, QLoader Product Preview, World and Regional Paintball Information Guide, Jul. 2003.

*Primary Examiner*—John A. Ricci

(57) ABSTRACT

A loader apparatus for use with a paintball marker having a paintball inlet is provided. The loader apparatus includes a base attachable to the paintball marker, a cartridge removably attachable to the base, a motive means and a delivery conduit. The cartridge includes a chamber for paintballs. The chamber has a paintball outlet. The cartridge further includes a flow assistor. The motive means is operatively connected to the flow assistor when the cartridge is attached to the base. The delivery conduit is in flow communication with the paintball outlet of the chamber and with the paintball inlet of the paintball marker when the cartridge is attached to the base and the base is mounted to the paintball marker.

35 Claims, 18 Drawing Sheets

U.S. PATENT DOCUMENTS

| | | | |
|---|---|---|---|
| 6,109,252 | A * | 8/2000 | Stevens |
| 6,213,110 | B1 | 4/2001 | Christopher et al. |
| 6,273,079 | B1 | 8/2001 | Jzn |
| 6,311,682 | B1 | 11/2001 | Rice et al. |
| 6,343,599 | B1 | 2/2002 | Perrone |
| 6,349,711 | B1 | 2/2002 | Perry et al. |
| 6,374,819 | B1 | 4/2002 | Ming-Hsien |
| D459,767 | S | 7/2002 | Rushton |
| 6,415,781 | B1 | 7/2002 | Perrone |
| 6,418,919 | B1 | 7/2002 | Perrone |
| 6,439,217 | B1 | 8/2002 | Shih |
| 6,467,473 | B1 | 10/2002 | Kostiopoulos |
| 6,470,872 | B1 | 10/2002 | Tiberius et al. |
| 6,474,326 | B1 | 11/2002 | Smith et al. |
| 6,481,432 | B1 | 11/2002 | Rushton et al. |
| 6,488,019 | B1 | 12/2002 | Kotsiopoulos |
| 6,502,567 | B1 | 1/2003 | Christopher et al. |
| 6,644,293 | B1 * | 11/2003 | Jong |
| 2002/0020402 | A1 | 2/2002 | Kotsiopoulos |
| 2002/0170552 | A1 | 11/2002 | Gardner, Jr. |
| 2004/0194772 | A1 | 10/2004 | Hamilton |

* cited by examiner

PAINTBALL MARKER LOADER APPARATUS

RELATED APPLICATIONS

This application is a Continuation-in-Part of application Ser. No. 09/901,589, filed on Jul. 11, 2001 now U.S. Pat. No. 6,644,293, which is still pending, the contents of which are incorporated herein by reference.

FIELD OF THE INVENTION

The present invention relates to loader apparatuses for paintball markers, and more particularly the invention relates to apparatuses which include removable paintball cartridges.

BACKGROUND OF THE INVENTION

Paintball games are today played with sophisticated paintball markers that can shoot as fast as the finger can pull the trigger. The marker is equipped with a fixed bulk loader which is mounted onto the paintball inlet of the marker. The paintballs are gravity fed from the loader into the paintball inlet of the marker often with the aid of a motorized flow assistor paddle or wheel located in the loader. The flow assistor is activated when a sensor in the neck of the loader senses an absence of paintballs leading down into the paintball inlet of the marker.

Many problems exist with these conventional loaders. Because the paintballs are gravity fed, the paintball marker must be held in a substantially vertical orientation in order that paintballs can be fed into the marker. As the angle of orientation of the marker changes away from the vertical, the efficiency of the paintball feed is reduced. At some critical angle, which varies depending on the design of the loader, paintball feed into the inlet of the marker, stops completely, making the marker ineffective. Furthermore, the sensors located in the neck of the loader, upon detecting the lack of paintball flow, will activate the flow assistor in an attempt to initiate paintball flow. The noise caused by the flow assistor actuation can inadvertently give away the location of the game player to others. While the activation of the flow assistor is important to maintain paintball flow, it is advantageous to reduce the frequency of activation to reduce the risk of disclosing the player's location to others. Furthermore, when a player moves a marker with a partially full loader, the paintballs inside the loader can rattle, also giving away the player's location.

Another common problem with conventional loaders is that the process for refilling an empty loader is both cumbersome and time consuming. The end cap on the loader must be opened and the player must fill the loader by pouring paintballs from a paintball storage tube, which is typically carried on the player's belt. The reloading process, while slow, is also prone to causing unwanted noise.

Another problem with conventional loaders is that the power source for the motor can fail during play, and is difficult and time consuming to replace. The power source can fail for several reasons, including a hardware failure or malfunction, or because the battery has been depleted of its stored energy.

Consequently, there is a need for a paintball loader apparatus for a marker that has at least one of the following features: the loader enables the marker to be operated in any orientation; the loader reduces unwanted noise from the flow assistor device and from the paintballs; and the loader enables the player to reload the loader with new paintballs and with a fresh power source quickly.

SUMMARY OF THE INVENTION

In a first aspect, the invention is directed to a loader apparatus for use with a paintball marker having a paintball inlet. The loader apparatus includes a cartridge, a motive means and a delivery conduit. The cartridge includes a chamber for paintballs. The chamber has a paintball outlet. The cartridge further includes a flow assistor. The motive means is operatively connected to the flow assistor when the cartridge mounted in communication with the delivery conduit. The cartridge is removably attachable with respect to the delivery conduit for communication of paintballs therewith. The delivery conduit is connectable with the paintball inlet of the marker.

In a preferred embodiment of this aspect of the invention, the loader may further include a pressurizing member in the chamber of the cartridge. The pressurizing member pushes paintballs in the chamber towards the paintball outlet.

In another preferred embodiment, the loader includes a base to which the cartridge is removably connectable, and which includes the delivery conduit.

In a second aspect, the invention is directed to a loader apparatus for use with a paintball marker having a paintball inlet, the loader apparatus including a cartridge and a delivery conduit. The cartridge includes a chamber for paintballs. The chamber has a paintball outlet and a pressurizing member for maintaining a force on the paintballs in the chamber to urge the paintballs in the chamber towards the paintball outlet. The pressurizing member is adapted to contact a plurality of paintballs simultaneously. The cartridge is removably connectable with respect to the delivery conduit for communication of paintballs from the paintball outlet of the chamber to the delivery conduit. The delivery conduit is fluidically connectable to the paintball inlet of the paintball marker for communication of paintballs therewith.

In a third aspect, the present invention is directed to a belt for use with a paintball loader apparatus having a base for the mounting of cartridges of paintballs. The belt includes a strap and at least one cartridge mounting assembly connected to the strap. The cartridge mounting assembly is adapted for holding a cartridge. In a preferred embodiment of the third aspect, the belt includes at least one battery pack mounting assembly connected to the strap, for holding a battery pack.

BRIEF DESCRIPTION OF THE DRAWINGS

The present invention will now be described by way of example only with reference to the attached drawings in which.

DETAILED DESCRIPTION OF THE INVENTION

Figure 1:
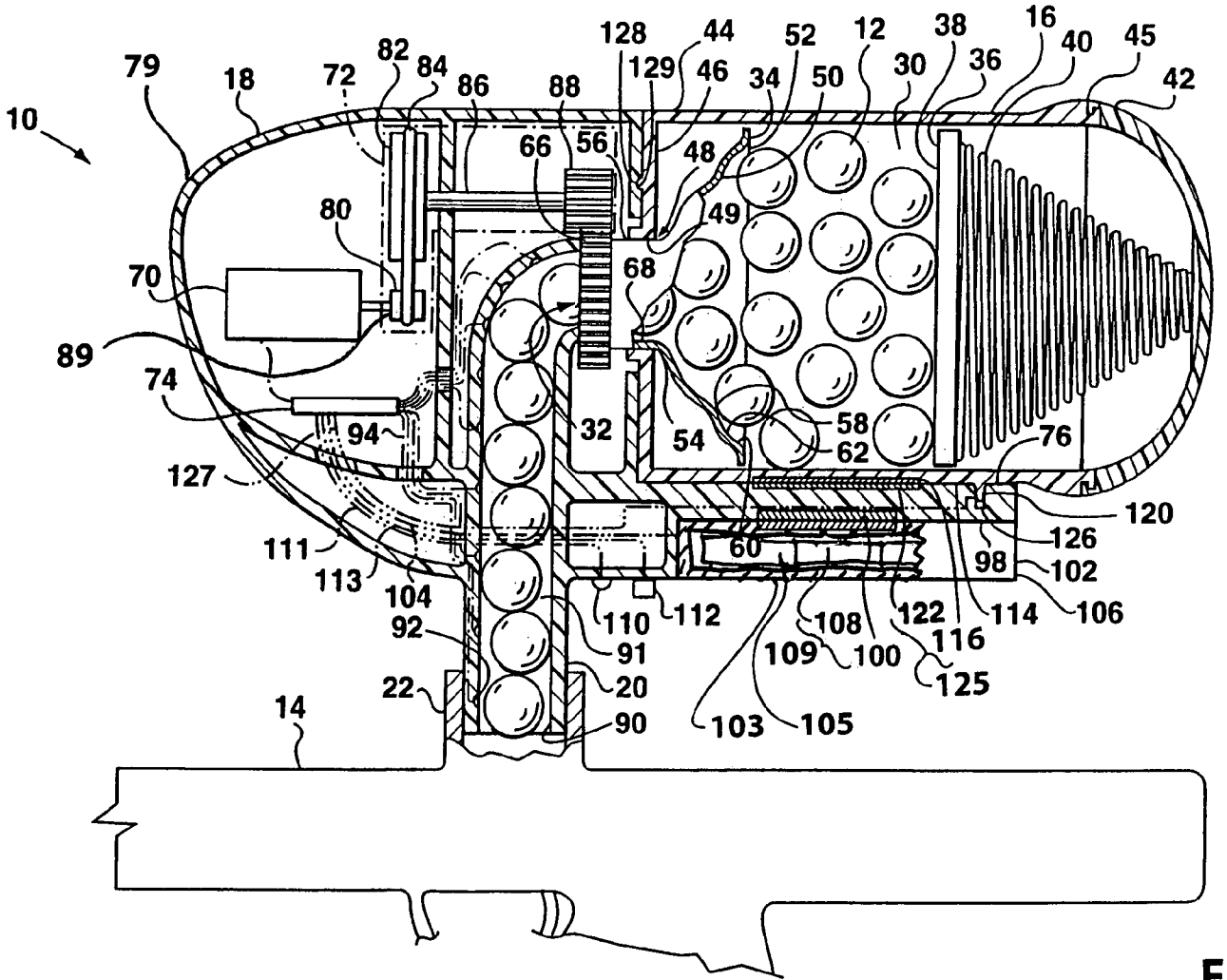
FIG. 1 is a sectional side view of a loader apparatus in accordance with an embodiment of the present invention.

Reference is first made to FIG. 1 which illustrates a loader apparatus 10 made in accordance with a first preferred embodiment of the present invention and which will be used for the purposes of describing the operational aspects of the invention.

Loader 10 is used to hold paintballs 12 and load paintballs 12 into paintball marker 14. Loader 10 comprises a paintball cartridge 16, a base 18 and a delivery conduit 20 which communicates with paintball inlet 22 of paintball marker 14.

Figure 1A:
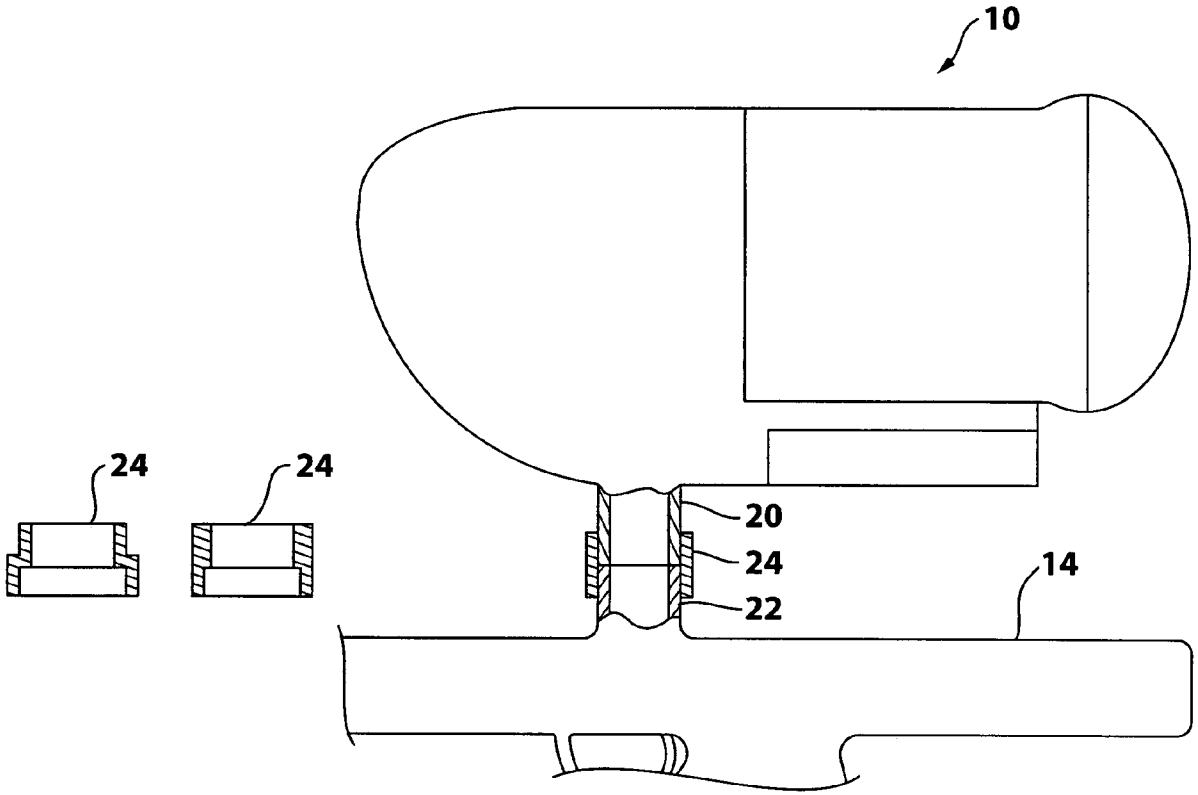
FIG. 1*a* is a side view of the loader apparatus shown in FIG. 1 with an optional set of adapters for connecting the loader apparatus to a paintball marker.

The delivery conduit 20 may connect to the inlet 22 of the marker 14 in any suitable way, such as by friction fit. Referring to FIG. 1*a*, an adapter 24 may be included to connect the delivery conduit 20 to the inlet 22. The adapter 24 may be a separate component, or may alternatively be attached to either the loader 10 or to the marker 14.

The loader 10 may include one or more adapters 24 to permit the conduit 20 to mount to paintball marker inlets 22 having different sizes. Some marker inlets 22 may have different inlet sizes. Also, some markers may have similar inner diameters for passing paintballs 12, but may have different outer diameters. The outer surfaces of such marker inlets 22 may also have different shapes. For example, the outside perimeter of the marker inlet may be square. The adapters 24 permit the loader 10 to mount to a greater range of markers, than the loader 10 would otherwise be mountable thereto. In an alternative embodiment not shown, a single adapter could be provided that, that is adjustable in size to permit the loader 10 to mount to inlets of different sizes. The adapters 24 may mount to marker inlets 22 by various means, such as by friction fit around a marker inlets. The adapters 24 may similarly connect to the delivery conduit 20 of the loader 10 by friction fit around the delivery conduit 20, or by any other suitable type of connection, such as a bayonet mount.

Cartridge 16 is removable from base 18 so that when cartridge 16 is empty, a user or player may remove cartridge 16 and replace it with a new one upon base 18. Cartridge 16 comprises a chamber 30 with an outlet 32, a flow assistor 34 and a pressurizing member 36. Chamber 30 holds paintballs 12. The chamber 30 may be sized to hold any suitable number of paintballs 12, in accordance with the needs of the player.

An outlet 32 is included in the front wall of chamber 30 and communicates with delivery conduit 20. Pressurizing member 36 maintains a force on paintballs 12 to push paintballs 12 towards outlet 32 of chamber 30. Pressurizing member 36 comprises a pressure plate 38 which is slidable within chamber 30, and a spring 40. Spring 40 acts on pressure plate 38, which contacts paintballs 12, to maintain a compressive force on paintballs 12. Spring 40 is conical shaped which reduces the compressed length of spring 40 thereby reducing the overall size of cartridge 16. By maintaining a compressive force on paintballs 12 the loader apparatus eliminates unwanted noise that can occur from the jiggling of paintballs within a partially full loader of the prior art. Such unwanted noise can inadvertently give away a player's position during a paintball game.

The spring 40 may alternatively be replaced by any other suitable mechanism. For example, an air bladder (not shown) may alternatively be used instead of a spring. The air bladder may be connected to the air tank (not shown) of the marker 14 and may receive a suitable pressure of air for pushing the pressure plate 38 towards the paintballs 12 to urge them towards the outlet 32.

The pressurizing member 36 is configured to contact a plurality of paintballs 12 simultaneously. Furthermore, the pressurizing member 36 can act on a plurality of paintballs 12 simultaneously without the need to have the paintballs 12 organized in any specific way in the chamber 30. Thus, the paintballs 12 may be randomly positioned in the chamber 30. This is advantageous, in that the user is not required to fill the chamber 30 in any special way. Instead, the chamber 30 may be refilled by simply pouring the paintballs 12 therein.

The fixed end of spring 40 is connected to an end cap 42. End cap 42 is removable from body 44 of cartridge 16 so that cartridge 16 is refillable with paintballs 12, preferably when the player is not engaged in play. End cap 42 and body 44 are preferably joined using a bayonet-style connection 45. However, any other style of connection that would enable end cap 42 to be removably attached is acceptable. Cartridge 16 also has an end wall 46 which has an opening 48 surrounded by a bearing portion 49.

The cartridge 16 may alternatively be refilled with paintballs 12 by other means. For example, the cartridge 16 may open at the end with the opening 48. Paintballs 12 may be inserted into the cartridge 16 via the opening 48. In this alternative, the end cap 42 may be replaced by a fixed end that is preferably integral with the body 44.

As a further alternative, the cartridge 16 may split along a line that is coincident with the entrance into the flow assistor 34. As another alternative, the cartridge 16 may include a porthole door that can be opened for refilling the chamber 30 with paintballs 12. In such embodiments, it may be advantageous for the pressurizing member 36 to be selectably lockable in a retracted position to facilitate loading of paintballs 12 in the chamber 30. A suitable locking mechanism (not shown) may be provided for this purpose. Once the chamber 30 is loader, the locking mechanism may be released permitting the pressurizing member 36 to act on the paintballs 12.

The body 44 and cap 42 of the cartridge 16 may be made from any suitable material, such as an organic polymer. The body 44 may be assembled by any suitable means, such as by bonding by, for example glue or epoxy, by snap-fit, by fasteners, such as screws, by ultrasonic 'Welding', or by friction fit. Alternatively, the body 44 may be a single piece that is molded, such as by injection molding. The cap 42 may be a single piece that may be molded by, for example, injection molding.

Flow assistor 34 is used to assist the flow of paintballs 12 out of outlet 32 by rotating, causing agitation of paintballs 12. The agitation thereby prevents paintballs 12 from wedging at outlet 32. Flow assistor 34 comprises a generally funnel-shaped agitation surface 50 which has a large end 52 which is slightly smaller in diameter than the inside diameter of chamber 30 and an annular small end 54 which is attached to a discharge tube 56. Agitation surface 50 includes surface irregularities 58 which include bosses 60 and dimples 62. Tube 56 passes through opening 48 in end wall 46 and is connected to an annular gear 66. Tube 56 and gear 66 have an inside tubular surface 68, the outlet of which is outlet 32. Tubular surface 68 is of a larger diameter than paintballs 12 but small enough to prevent wedging of paintballs 12.

Base 18 houses the drive and controls for flow assistor 34. Base 18 comprises a motive means 70 driving a driven means 72, a controller 74 and a cartridge mounting surface 76. As w 11, delivery tube 20 is formed integrally with base 18. Base 18 mounts to paintball marker 14 by engaging delivery conduit 20 with marker inlet 22.

The housing of the base 18 is shown at 79. The housing 79 may be made from any suitable material, such as an organic polymer. The housing 79 may be assembled by any suitable means, such as by bonding by, for example glue or epoxy, by snap-fit, by fasteners, such as screws, by ultrasonic 'welding', or by friction fit. Alternatively, the housing 79 may be a single piece that is molded, such as by injection molding.

The motive means 70 may be an electric motor, or may alternatively be any suitable motive means. For example, the motive means 70 may be an air motor (ie. a motor that operates using compressed gas pressure instead of electricity). The motive means 70 may alternatively be a spring or some other potential energy storage device. For example, if the motive means 70 is a spring, it could be a torsion spring that could be wound up to store sufficient energy to rotate the flow assistor 34 for a selected period of time or a selected number of rotations.

Driven means 72 transfers rotational power from motive means 70 to gear 66 for driving flow assistor 34. Driven means 72 includes a drive pulley 80, a driven pulley 82, a belt 84, a shaft 86, and a gear 88. Pulley 80 may be driven directly by motive means 70 and drives pulley 82 by means of belt 84. Shaft 86 extends from the centre of pulley 82 connecting pulley 82 to gear 88. Gear 88 contacts gear 66 when cartridge 16 is mounted on base 18, to drive gear 66 and flow assistor 34. Gear 66 is a second driven means for operatively connecting flow assistor 34 to motive means 70.

It is alternatively possible for any driven means to replace the driven means 72. For example, the belt 84 may be a toothed belt and the pulleys 80 and 82 may be toothed, providing improved grip. As another example, the pulleys 80 and 82 and the belt 84 may be replaced by a gear train, which may include two or more gears.

To assist in the meshing of gears 88 and 66 when cartridge 16 is mounted on base 18, there is play in the fit between gear 88 and gear 66. Furthermore gears 88 and 66 may also include chamfering of the edges of the gear teeth to further assist in their meshing. As well, because pulleys 80 and 82, and belt 84 are incorporated into driven means 72, gear 88 can be rotated as required, taking advantage of belt slippage, in order to further assist in the meshing of gears 88 and 66.

Delivery conduit 20 has an interior surface 90 that defines a passageway 91. Passageway 91 has a diameter larger than paintballs 12 but not so large as to allow the wedging of paintballs 12.

Sensors 92 may be spaced along the entire length of passageway 91 to sense the presence of paintballs 12 within passageway 91.

The sensors 92 communicate with the controller 74 to indicate whether or not paintballs 12 are present in the delivery conduit 20.

Sensors 92 send signals to controller 74 through electrical conduits 94. The sensors 92 may be mounted flush with surface 90 of the passageway 91. Alternatively, the sensors 92 may be embedded within the conduit 20, and may be recessed from the surface 90.

The sensors 92 may be mounted into apertures that are provided in the conduit 20. Alternatively, the sensors 92 may be molded directly into the conduit 20.

Sensors 92 may be infrared sensors or any other sensors that will detect a body such as a paintball 12. For example, some alternative types of sensor that could be used are proximity sensors, lever-trip sensors, vibration sensors or tilt sensors.

On the bottom of base 18 is a battery pack mounting surface 98. A battery pack 102 may be removably attached to base 18 and supplies power to controller 74 and to motive means 70 through electrical conduit 104.

It is alternatively possible for the battery pack 102 to be remote from the rest of the loader 10. For example, in an embodiment that is not shown, the battery pack 102 may be worn on a belt, and the electrical conduit 104 may be an insulated wire that extends outwards from the base 18 to connect to the battery pack 102.

As a further alternative the battery pack 102 may mount to the marker itself and to connect to the base 18 by means of an outwardly extending electrical conduit 104.

The battery pack 102 includes a housing 103 and includes a plurality of batteries 105. The batteries 105 may be any suitable batteries, and may be rechargeable. For example, the batteries 105 may be, for example, Lithium ion, Nickel metal hydride, or Nickel Cadmium. The batteries 105 may instead comprise a fuel cell.

In embodiments where the battery pack 102 is rechargeable, the loader may further include a photo-voltaic cell or cell array (not shown) which may be mounted on the exterior of the loader 10 or the marker 14 for gathering light and converting the light to energy for recharging the battery pack 102. In this way, the battery pack 102 may be recharged during play, particularly when such play is outside.

Alternatively, the batteries 105 may be non-rechargeable, such as alkaline batteries, and may be removable from the battery pack 102 for disposal and replacement. As a further alternative, the entire battery pack 102 may be disposable.

Instead of having a plurality of batteries 105, the battery pack 102 may have a single battery 105. The single battery 105 may be sized and configured based on the contained volume of the battery pack housing 103.

The battery pack 102 may generate any suitable voltage. For example, the battery pack 102 may generate 5V to operate the loader. Alternatively, the battery pack 102 may generate some other voltage, such as 48V. In embodiments where the battery pack 102 generates a higher voltage than is required for operation of some or all of the electrical components of the loader 10, then the voltage may be reduced by a suitable device, such as a voltage regulator, that may be included in the controller 74 or that may be separate from the controller 74.

The electrical conduit 104 may connect to the battery pack 105 by any suitable means, such as by contact plates, which may be fixed, or which may be resilient. Another suitable means would be battery clips, which clip to the battery terminals. Other suitable means such as protrusions, bumps and the like may be alternatively used.

A connector 109 connects the battery pack 102 to the base 18. The connector 109 may be any suitable type of connector, such as, for example, a magnet 100 and a member 108 that is magnetically attracted to the magnet 100. The magnet 100 may be in the form of a plate that is flush-mounted on the battery pack mounting surface 98. The magnet 100 may be any type of magnet, such as a permanent magnet, or an electromagnet.

The member 108 is mounted on the housing 103 of the battery pack 102. The member 108 may be any material that is attracted to a magnet. For example, the member 108 may be another magnet. Alternatively, the member 108 may be a material that is non-magnetic. For the purposes of this disclosure, a non-magnetic material is a material that is not inherently magnetic. However, a non-magnetic material may become magnetic when it is in contact with a magnetic material. For example, carbon steel is not inherently magnetic, however, it is attracted to magnets, and can become magnetic when in contact with a magnetic material.

The magnet 100 may be positioned on the base 18 and the member 108 may be positioned on the battery pack 102, as shown in FIG. 1. Alternatively however, the magnet 100 may be positioned on the battery pack 102, and the member 108 may be positioned on the base 18.

The connector 109 may be another types of connector instead of the magnet 100 and member 108. For example, the connector 109 may include a hook-and-loop fastener, whereby a hook portion is mounted on one of the base 18 or the battery pack 102 and the loop portion is mounted on the other of the base 18 or the battery pack 102. Alternatively, the connector may include a latch mechanism or a clip mechanism to clip the battery pack 102 to the base 18.

Controller 74 receives signals from sensors 92 and operates motive means 70 to rotate flow assistor 34 when any of sensors 92 do not detect a paintball 12, suggesting that passageway 91 is not full of paintballs 12. Controller 74 also regulates the voltage of power from battery pack 98 to motive means 70. As well, controller 74 monitors the power level in battery pack 98, and activates a warning indicator 110 giving notice to the user, so that the user can change the old battery pack 102 for a fresh one. Warning indicator 110 is preferably located towards the rear of base 18, so that it can be viewed by the user, but is at least partially hidden from view by others. Warning light 110 is connected to controller 74 by an electrical conduit 111.

Figure 13:
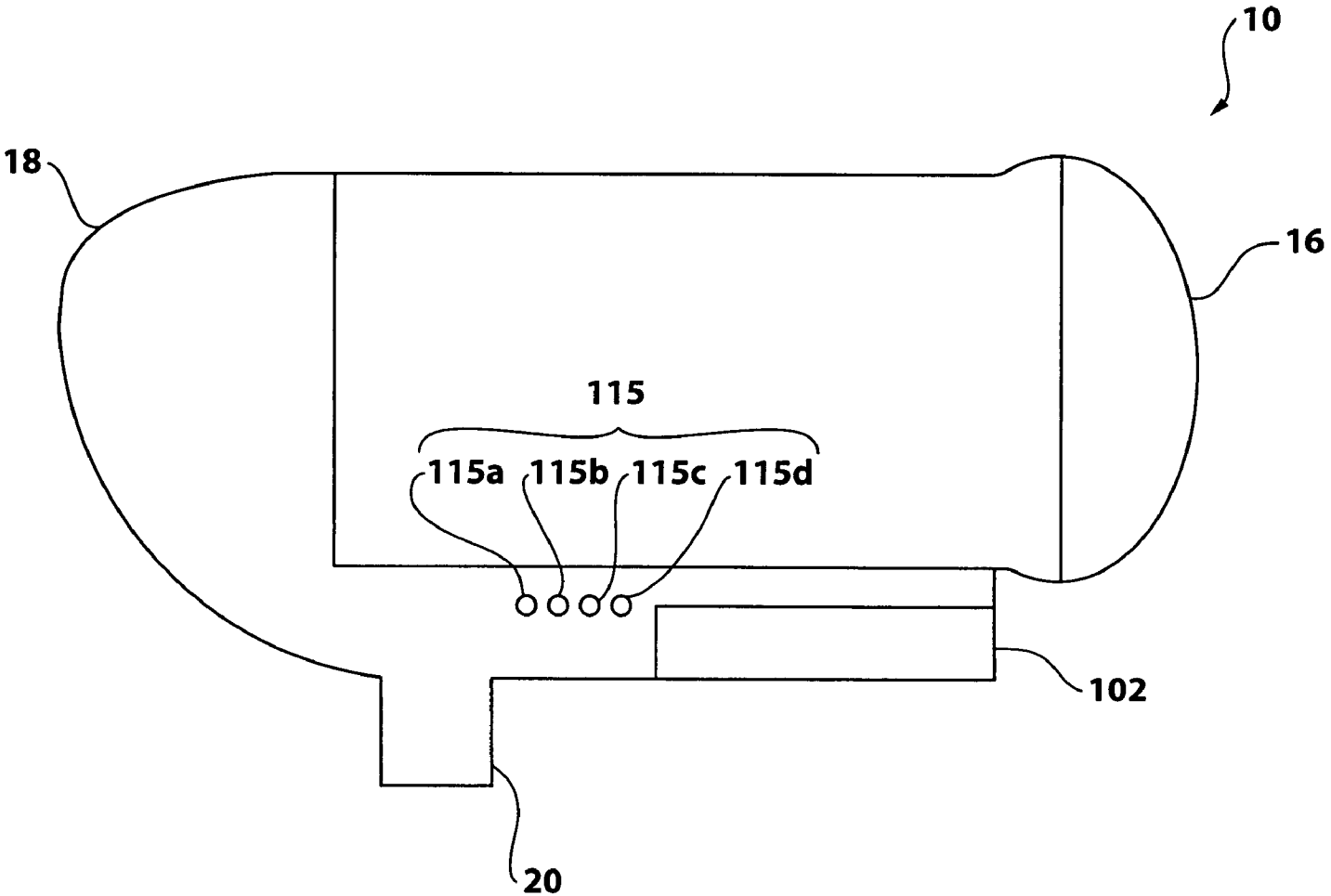
FIG. 13 is a side view of the loader shown in FIG. 1, with optional display indicators relating to the status of certain parameters of operation.

Reference is made to FIG. 13, which shows a plurality of other indicators 115 that may optionally be included on the loader 10 in addition to the warning indicator 110. The indicators 115 include a first indicator 115*a* which indicates whether power is on or off, a second indicator 115*b* which indicates a condition wherein the cartridge has few balls remaining, a third indicator 115*c* which indicates when the cartridge is empty, and a fourth indicator 115*d* to indicate whether the battery pack 102 is low in stored energy.

The indicators 115 may be any type of indicator, such as, for example, LEDs (light emitting diodes) or conventional bulbs. They may alternatively be part of an LCD (liquid crystal display) screen.

The indicators 115 may be arranged in any way to suit the needs of the user.

As a further alternative, one or more of the indicators 115 may indicate a condition using some other means than displaying the information. For example, the indicators 115*c* and 115*d* may comprise a vibrator device that could be activated to notify the user that a low-balls condition or a low battery condition exists. The vibrator device may vibrate in several different ways to indicate the exact condition without the need for the user to take time and look at the display. A vibrator device is also advantageous over indicators of the prior art that emit sounds to indicate a condition, since sound indicators can give away a player's position inadvertently.

Referring to FIG. 1, an on/off switch 112 is included on base 18, and provides the player with manual control for turning controller 74 on and off. In the exemplary preferred embodiment, power must pass through controller 74 to reach motive means 70. If switch 112 is in the 'off' position, then power is not sent to controller 74 and motive means 70, and if switch 112 is in the 'on' position, then power is sent to controller 74, which can in turn send power to motive means 70. On/off switch 112 may be connected to controller 74 by an electrical conduit 113. The on/off switch 112 may operatively control the electrical connection between the battery pack 102 and the controller 74, or alternatively, between the battery pack 102 and the motive means 70.

The on/off switch 112 may be any suitable kind of switch. For example, the on/off switch 112 may be a toggle switch, a push button, a micro-switch, a membrane or a solid state switch. The switch 112 may be positioned anywhere on the loader 10 suitable for its intended purpose.

Figure 2A:
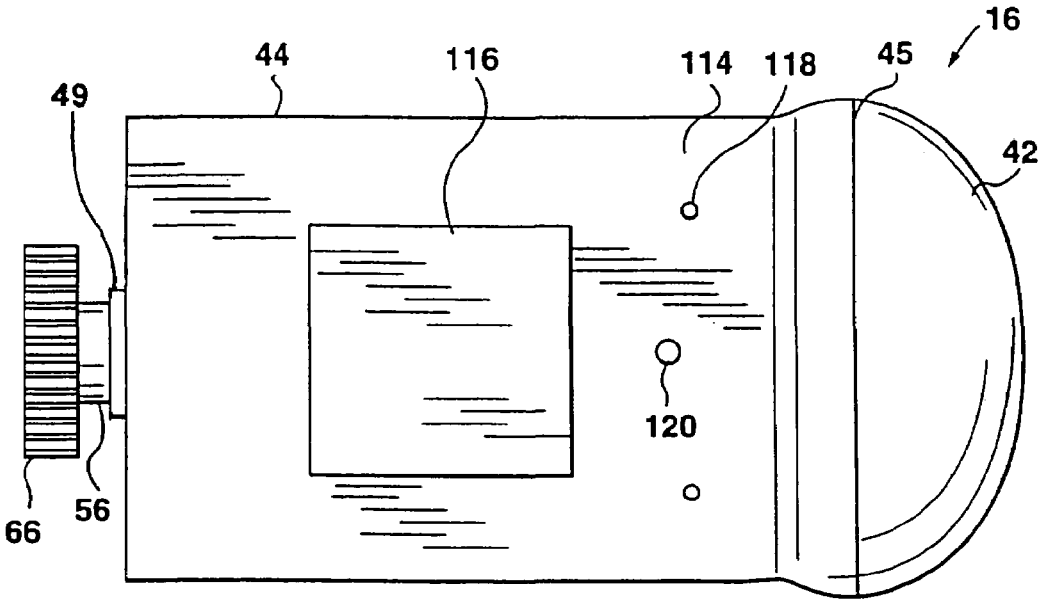
FIG. 2*a* is a bottom plan view of the cartridge of FIG. 1.
Figure 2B:
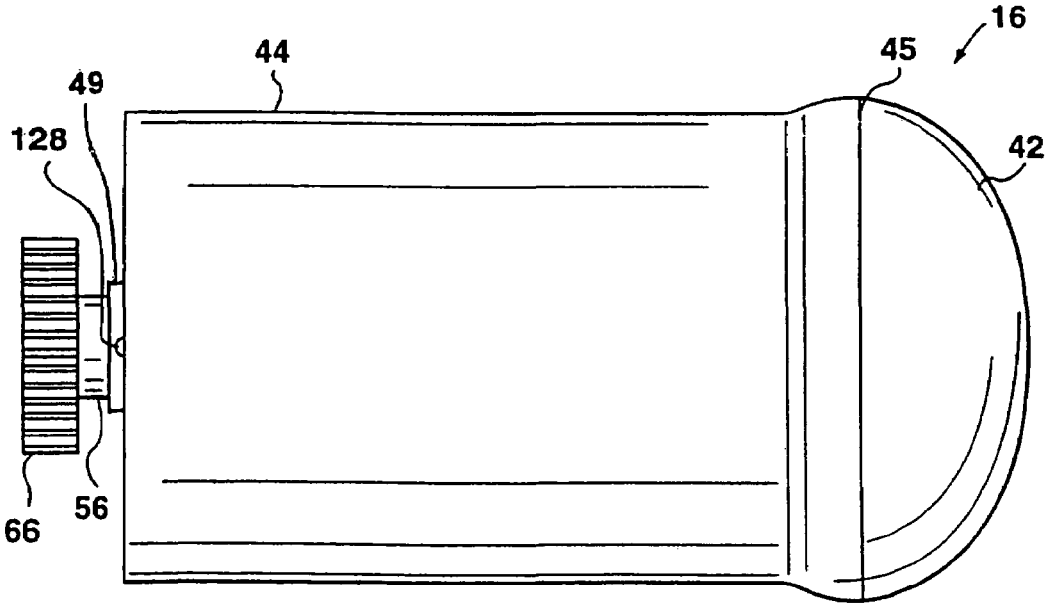
FIG. 2*b* is a top plan view of the cartridge of FIG. 1.
Figure 3:
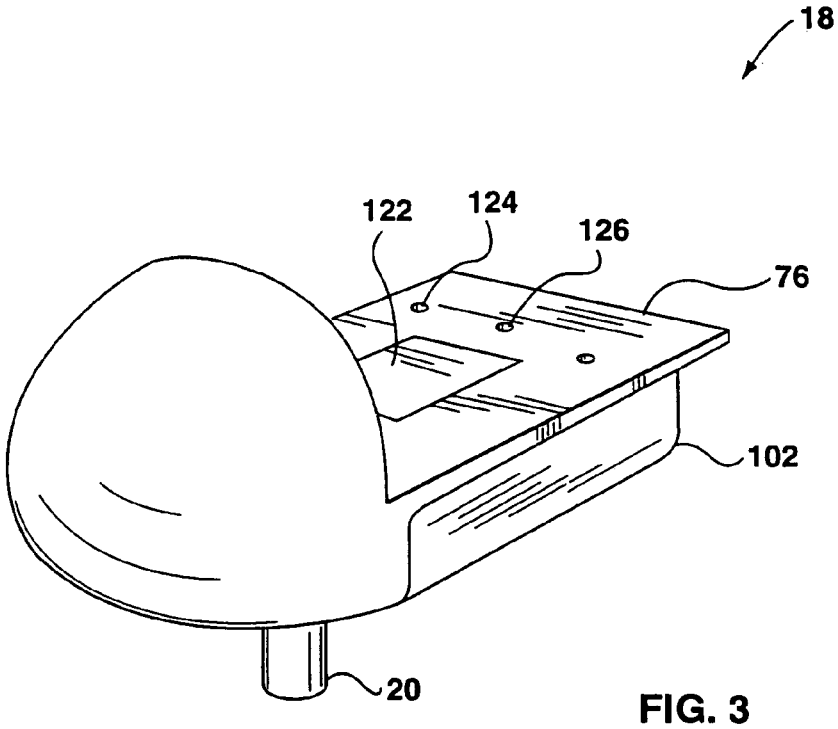
FIG. 3 is a perspective view of the base of FIG. 1.

Reference is made to FIGS. 2*a*, 2*b* and 3, which show cartridge 16 and base 18 separately. As shown in FIGS. 2*a* and 3, the exterior of cartridge 16 includes a mating surface 114 which mates with mounting surface 76 of base 18. Mating surface 114 includes two locator bosses 118 and an activator boss 120. Mounting surface 76 of base 18 includes two locating recesses 124 for receiving locator bosses 118 and an activator switch 126 which is activated when contacted by activator boss 120. Switch 126 effectively detects the presence of cartridge 16 by contact with activator boss 120 and signals the presence to controller 74.

A connector 125 is provided for releasably connecting the cartridge 16 to the base 18. The connector 125 may include a magnet 122 mounted on the base 18 and a member 116 mounted on the cartridge 16, that is attracted to the magnet 122. The connector 125 assists in retaining the cartridge 16 on the base 18, in addition to the locating bosses 118 and locating recesses 124, which further assist in maintaining and positioning cartridge 16 on base 18.

The member 116 may be a magnet itself, or it may be any material that is not magnetic but is attracted to a magnet, such as carbon steel.

The magnet 122 may be positioned on the base 18 and the member 116 may be positioned on the cartridge 16, as shown in FIG. 1. Alternatively, however, the magnet 122 may be positioned on the cartridge 16, and the member 116 may be positioned on the base 18.

The connector 125 may be another type of connector instead of the magnet 122 and member 116. For example, the connector 125 may include a hook-and-loop fastener, whereby a hook portion is mounted on one of the base 18 or the cartridge 16 and the loop portion is mounted on the other of the base 18 or the cartridge 16. Alternatively, the connector may include a latch mechanism or a clip mechanism to clip the cartridge 16 to the base 18.

The connector 125 may also alternatively include a bayonet mechanism or threaded connection for mounting the cartridge 16 to the base 18.

The member 116 may be made from a material that is a permanent magnet, and the magnet 122 may be made from a material that is not magnetic. For example, the magnet 122 may be made from carbon steel, which is attracted to magnets, but is not magnetic itself when positioned away from any magnetic fields.

Referring to FIG. 1, when cartridge 16 is mounted on base 18 and boss 120 is in contact with switch 126, a signal is sent to controller 74 through electrical conduit 127 indicating that a cartridge 16 is present and that motive means 70 can be operated as required. When cartridge 16 is removed from base 18, then controller 74 is notified that cartridge 16 is not present. In the event that controller 74 is prompted to actuate motive means 70, (for example, by sensors 92), motive means 70 will only be actuated if controller 74 is signaled that a cartridge 16 is present. Switch 126 is connected to controller 74 by an electrical conduit 127. Controller 74 operates motive means 70 when boss 120 contacts switch 126 and prevents the actuation of motive means 70 when boss 120 does not contact switch 126.

A summary description of the logic by which controller 74 operates motive means 70 will now be provided. When switch 112 is 'off', when switch 126 is not contacted by activator boss 120, or when battery pack 102 does not have enough power, then controller 74 cannot operate motive means 70. When switch 112 is 'on', when switch 126 is contacted by boss 120 and when battery pack 102 has enough power, controller 74 can operate motive means 70. When any of sensors 92 detect a gap between paintballs 12 in passageway 91, then controller 74 operates motive means 70 (and flow controller 34), provided that switch 112 is 'on', battery pack 102 has enough power, and switch 126 is contacted by boss 120.

As shown in FIGS. 1 and 2*b*, cartridge 16 includes a boss 128 which mates with a recess 129 on base 18. Boss 128 and recess 129 together with magnet 122 and the member 116, and bosses 118 and recesses 124, help keep cartridge 16 positioned on base 18.

Alternatively, the cartridge 16 and base 18 may include matable irregularities on their respective mounting surfaces, which cooperate to retain the cartridge 16 in position on the base 18, instead of, or in conjunction with the connector 125, and the bosses 118 and recesses 124.

Figure 11A:
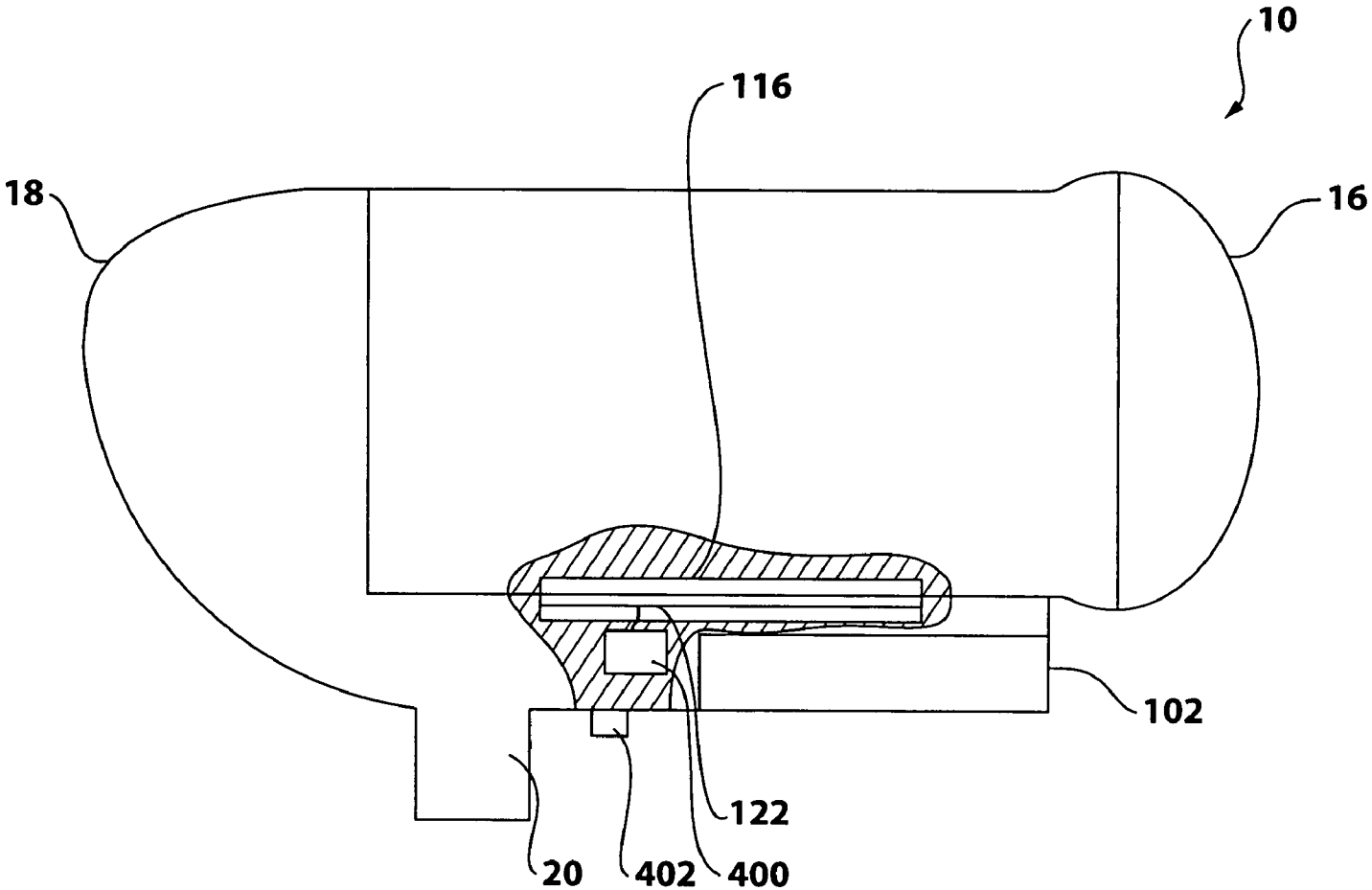
FIG. 11*a* is a side view of the loader shown in FIG. 1, with an optional mechanism to facilitate removal of the cartridge from the base, in a first position prior to actuation of the mechanism.
Figure 11B:
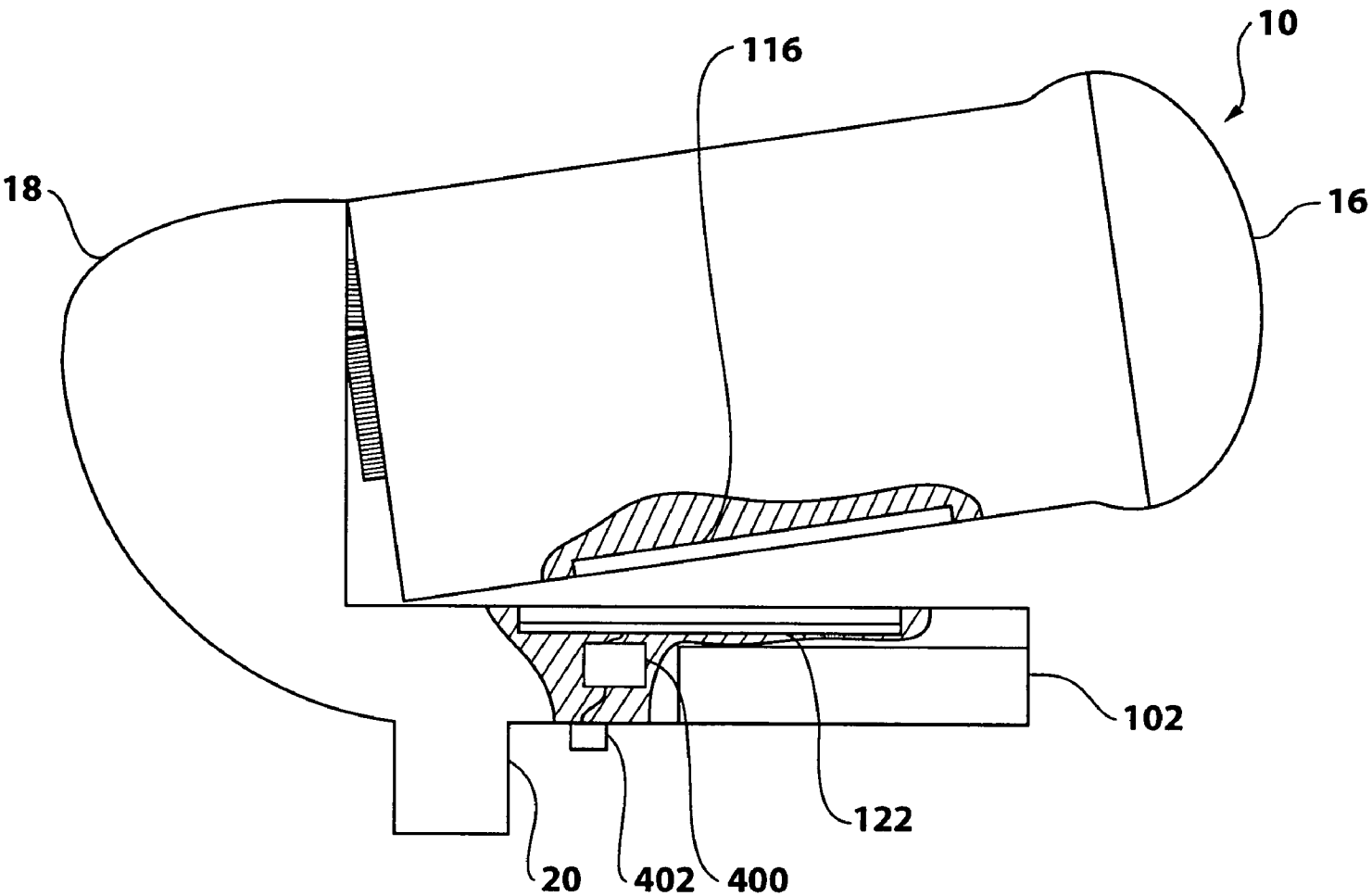
FIG. 11*b* is a side view of the loader shown in FIG. 1, with an optional mechanism to facilitate removal of the cartridge from the base, in a second position after actuation of the mechanism.

To remove the cartridge 16 from the base 18, the cartridge 16 may be released manually by the user. In other words, to remove the cartridge the user may grip the cartridge and manually pull it away from the base. The removal operation can alternatively be automated to some degree. Referring to FIGS. 11*a* and 11*b* the attractive force between the magnet 122 and the member 116 may be reduced or eliminated to facilitate removal of the cartridge 16 from the base 18.

The reduction or elimination of the attractive force between the magnet 122 and the member 116 may be accomplished in several other ways. For example, one or both of the magnet 122 and the member 116 may be moveable so that the distance between them can be adjusted between a first distance (see FIG. 11*a*) wherein they are relatively close to provide a relatively strong attractive force to retain the cartridge 16 on the base 18 and a second position (see FIG. 11*b*) wherein they are positioned relatively far apart to reduce or substantially eliminate the attractive force between them to facilitate removal of the cartridge 16 from the base 18.

Alternatively, the magnet 122 may be an electromagnet and may be deactivated electrically. The member 116 in such an embodiment would preferably be a non-magnet.

In the case when in FIGS. 11*a* and 1*b*, whereby the magnet 122 is moveable, a motive means 400 for moving the magnet 122 between the first and second positions is provided. The motive means 400 may include a mechanical linkage that is manually actuated via a lever mounted on the exterior of the base 18. Alternatively, the motive means 400 could include an electric actuator, such as a solenoid, for moving the magnet 122.

A switch 402 may be operatively connected to the magnet 122 and/or the member 116 for initiating the reduction of the magnetic force between the magnet 122 and the member 116. The switch 402 may be an electrical switch or a mechanical switch. Examples of switch 402 include a toggle switch, a button, a lever, a membrane and an electrically sensitive touch surface.

The switch 402 may be positioned on the bas 18, particularly for embodiments where the switch operates the magnet 122. Particularly for an embodiment using an electric actuator, the switch 402 could be positioned remotely from the base 18 so that it is more easily accessible by the same hand that is holding the marker 14, thus leaving the other hand free to remove the cartridge 16. For example, the switch 400 could be positioned on the marker 14 itself near the trigger and could communicate with a control means, such as the controller 74 using any suitable kind of wireless signal.

Figure 12:
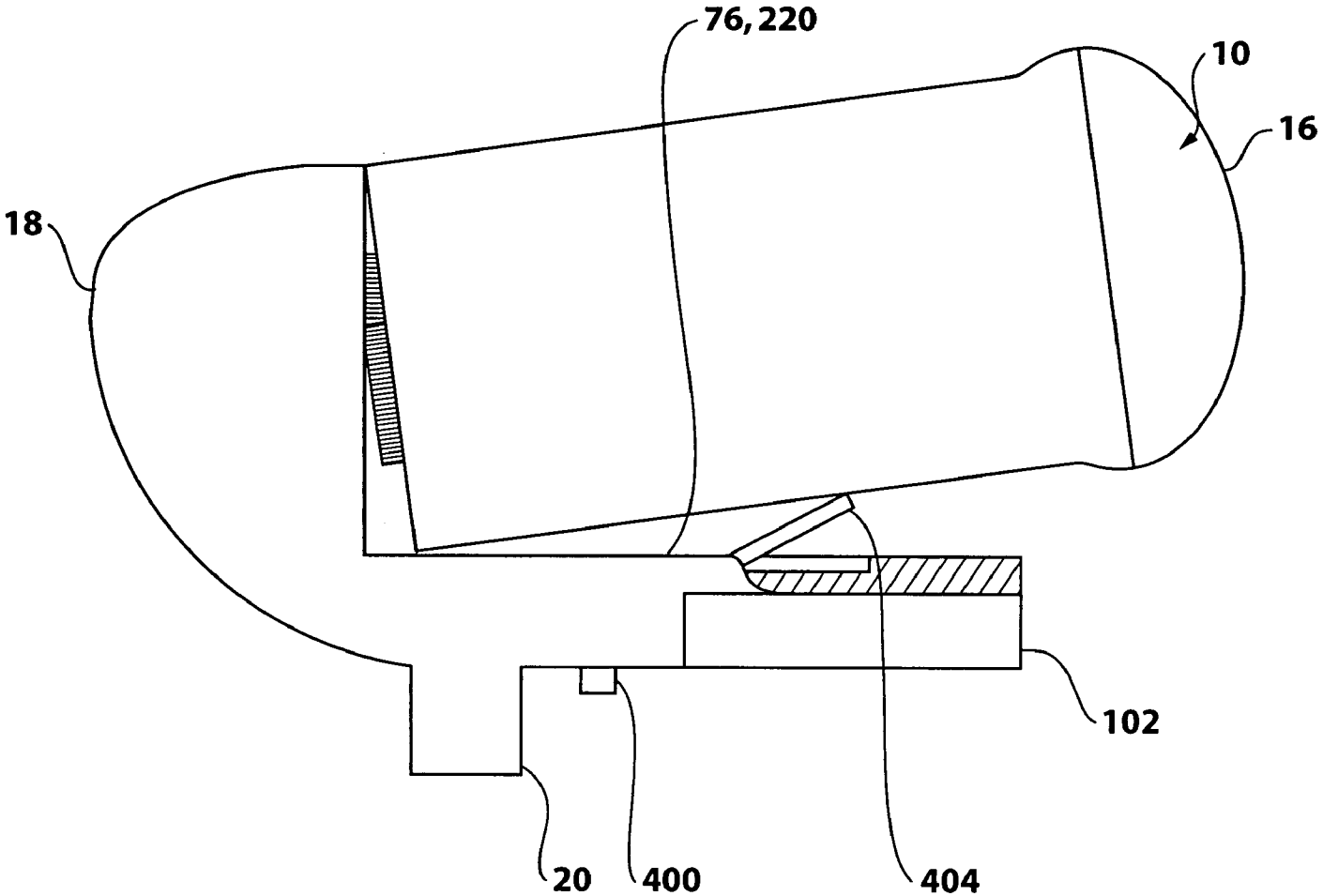
FIG. 12 is a side view of the loader shown in FIG. 1, with another optional mechanism to facilitate removal of the cartridge from the base.

Referring to FIG. 12, the system for assisting in the removal of the cartridge 16 could alternatively Include a mechanical switch 400 connected to a lever 404 that is positioned on the mounting surface 76, 220 on the base 18. The lever 404 moves between a retracted position wherein the cartridge 16 is permitted to be connected to the base 18, and an extended position, wherein the lever 404 projects outwards from the mounting surface 220 to urge the cartridge 16 away from the mounting surface 76, 220. A suitable mechanical linkage is provided to operatively connect the switch 400 and the lever 404.

Figure 4B:
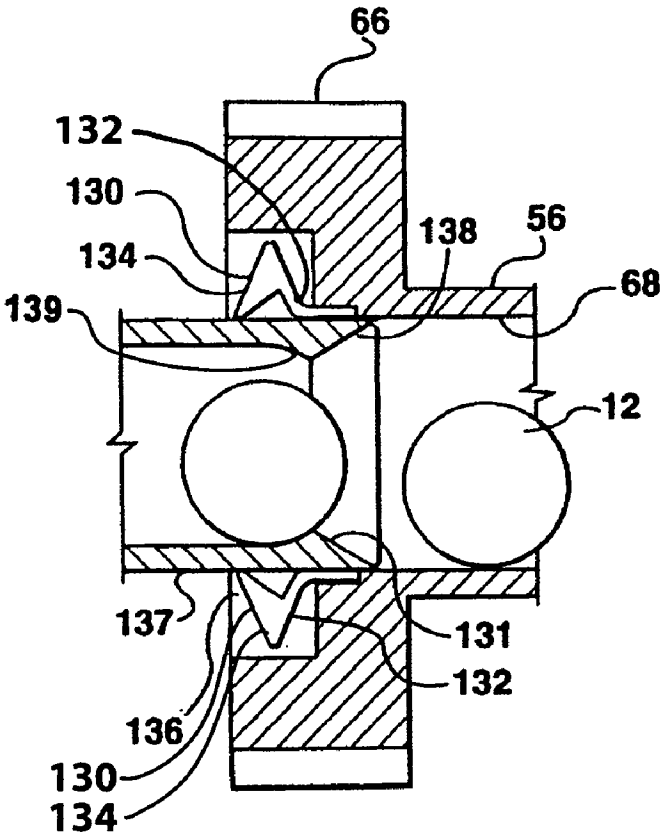
FIG. 4*b* is a side view of the outlet and inlet portions shown in FIG. 4*a*, when the cartridge is mounted on the base.
Figure 4A:
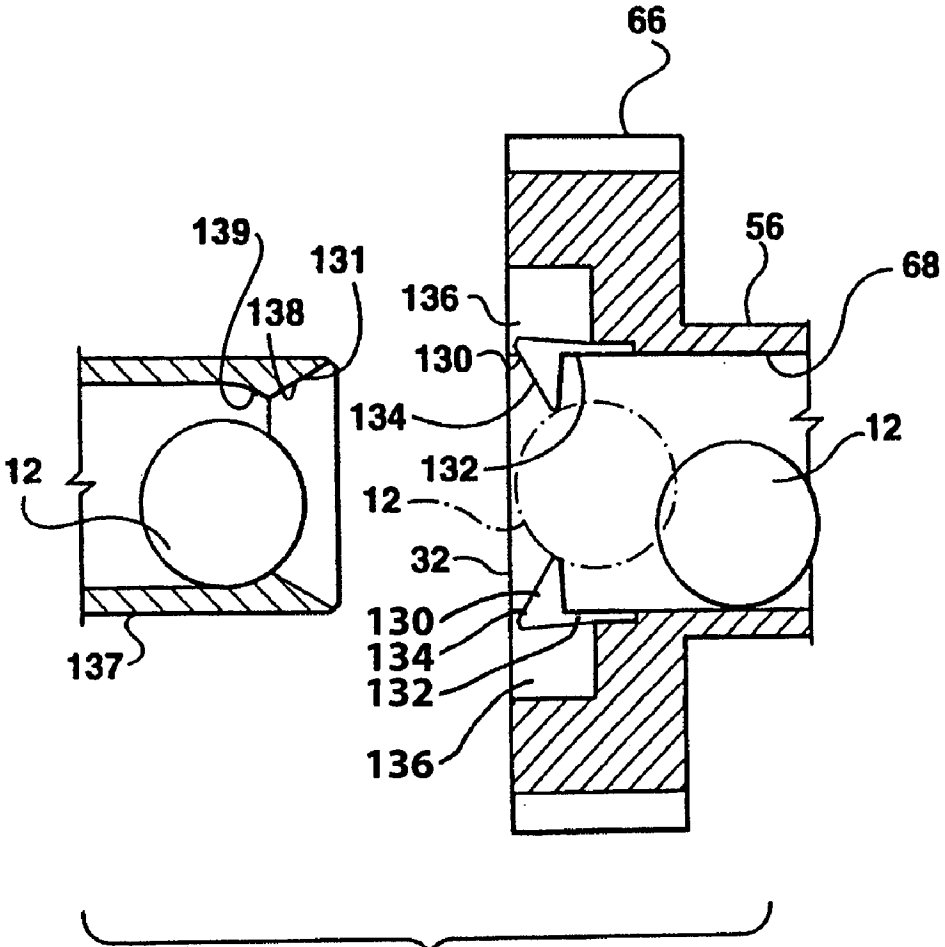
FIG. 4*a* is a side view of the outlet portion of the cartridge of FIG. 1 and the inlet portion of the delivery conduit of FIG. 1, when the cartridge is removed from the base.

Reference is made to FIGS. 4*a* and 4*b* which show a sectional side view of gear 66 and discharge tube 56, and which show flow preventers 130 and 131. As shown in FIG. 4*a*, cartridge flow preventer 130 and base flow preventer 131 prevent the spillage of paintballs 12 from outlet 32 and from the inlet of passageway 91 respectively, when cartridge 16 is not mounted on base 18. FIG. 4*b* shows flow preventers 130 and 131 when cartridge 16 is mounted on base 18.

Cartridge flow preventer 130 comprises retractable stops. The stops extend radially inwards from surface 68 to prevent the flow of paintballs out from outlet 32. The stops can be retracted, however, to permit the flow of paintballs out from the outlet 32. The stops include a plurality of arms 132 which are made from a resilient flexible material. Such a material is preferably a resilient flexible polymer, which will not damage paintballs 12. Arms 132 are mounted fixed at one end into surface 68 and include wedge shaped nubs 134. Nubs 134 project into outlet 32 as shown in FIG. 4*a* when cartridge 16 is not mounted on base 18, preventing the flow of paintballs 12 through outlet 32. Cartridge flow preventer 130 therefore prevents the flow of paintballs 12 through outlet 32 when cartridge 16 is not mounted on base 18. A recess 136 is included underneath the free end of each of arms 132. Recess 136 is sized so that if arm 132 is depressed as shown in FIG. 4*b*, no part of arm 132 or nub 134 would project into outlet 32. As shown in FIG. 4*b*, when cartridge 16 is mounted on base 18, a passageway inlet tube 137 which projects from base 18 and which communicates with passageway 91, projects into outlet 32, pushing nubs 134 and arms 132 into recesses 136, allowing paintballs 12 to flow through outlet 32.

When cartridge 16 is removed from base 18, the arms 132 return to their original position to extend radially inwards from surface 68, due to their resiliency, so that they prevent the flow of paintballs 12 from outlet 32.

Base flow preventer 131 includes a leading edge surface 138 and a trailing edge surface 139. Preferably as shown in FIGS. 4*a* and 4*b*, surface 138 slopes smoothly from a diameter substantially equal to that of tubular surface 68, to a diameter slightly larger than paintballs 12. The trailing edge surface 139 of flow preventer 131 is preferably contoured to hold and partially cup a paintball 12, to inhibit paintball 12 from rolling backwards out of the inlet of passageway 91. Together, surfaces 138 and 139 permit the entry of paintballs 12 into the inlet of passageway 91, but inhibit paintballs 12 from rolling out of the inlet of passageway 91.

Figure 5:
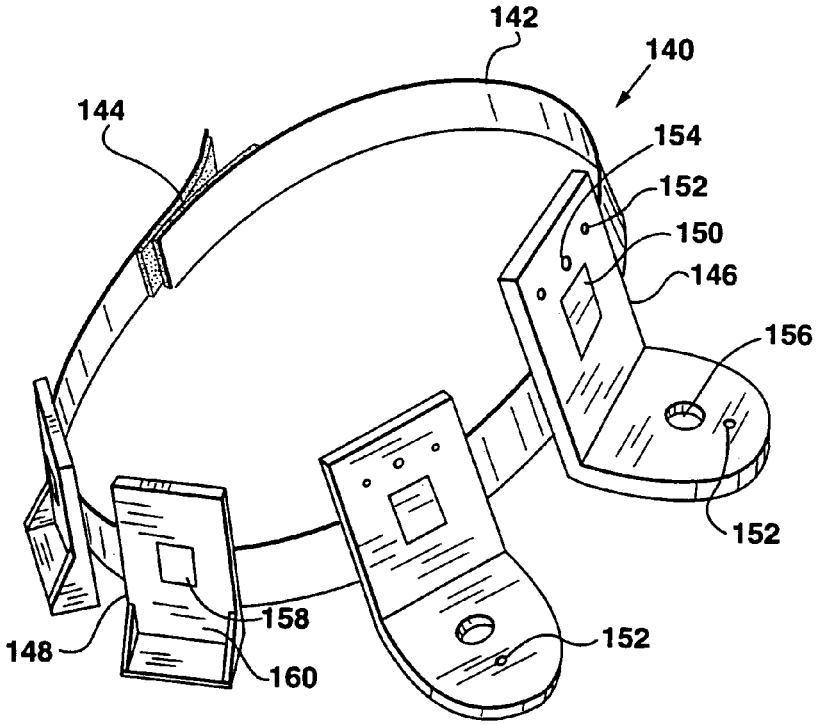
FIG. 5 is a perspective view of a storage belt for cartridges and battery packs.

Reference is made to FIG. 5, which shows a belt 140 which can be worn by the player and which stores both spent and full replacement cartridges 16. Belt 140 comprises a strap 142, a closure 144 such as Velcro (TM), a plurality of mounting assemblies 146 for receiving spent or fresh cartridges 16, and a plurality of mounting assemblies 148 for holding spent or fresh battery packs 102. Mounting assembly 146 includes a complementary portion to the connector portion that is present on the cartridge 16. For example, in the embodiment of the cartridge 16 that has the member 116, then the mounting assembly 146 may include the magnet 122. Furthermore, the mounting assembly 146 includes two locating recesses 152 for receiving locating bosses 118 and a locating recess 154 for receiving activator boss 120. As well, mounting assembly 146 includes an opening 156 for gear 66.

Mounting assembly 148 includes a complementary portion to the connector portion that is present on the battery pack 102. For example, in the embodiment of the battery pack 102 that has the member 108, then the mounting assembly 146 may include the magnet 100.

Figure 6:
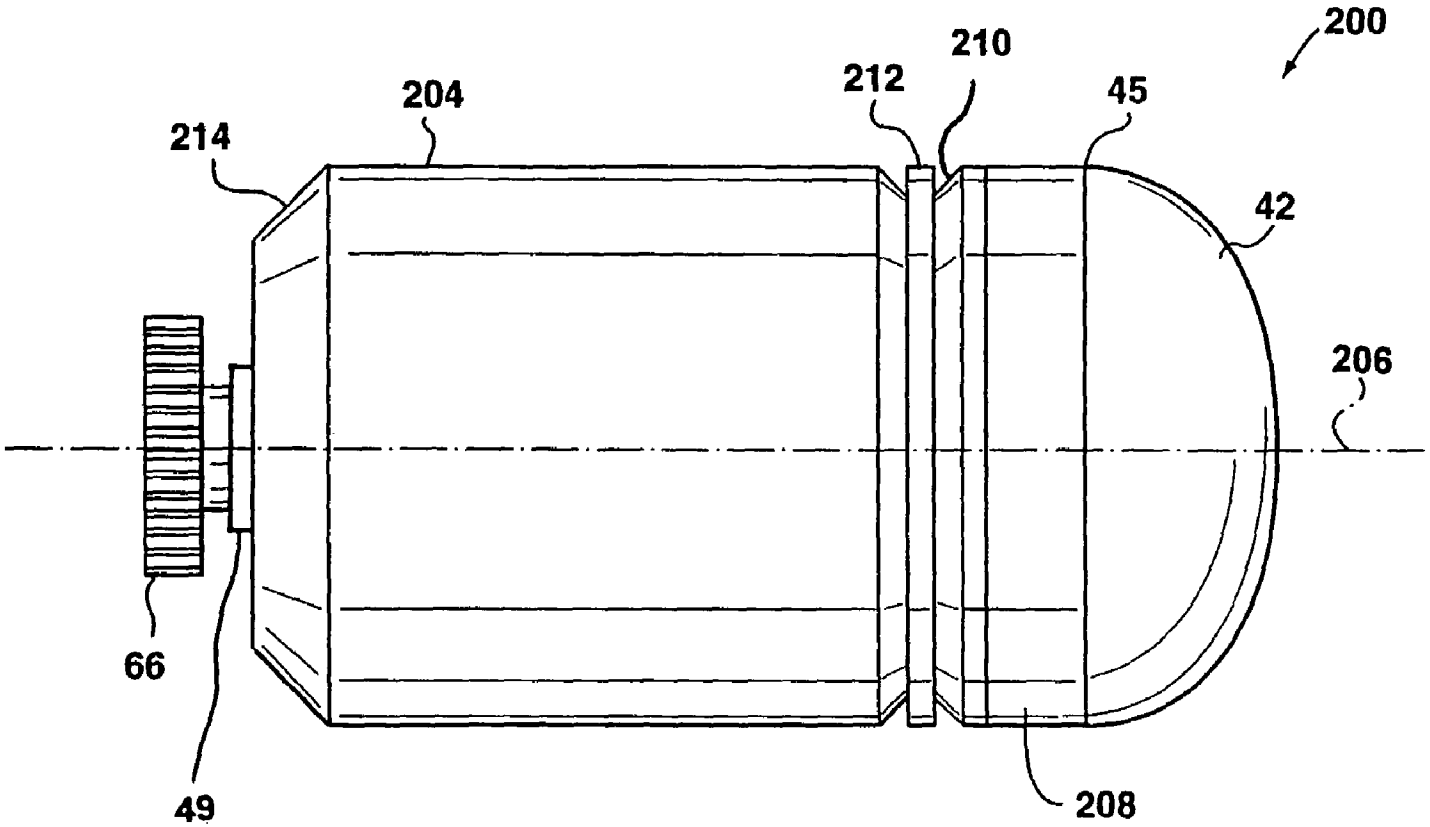
FIG. 6 is a top plan view of a cartridge in accordance with an alternative embodiment of the present invention.
Figure 7:
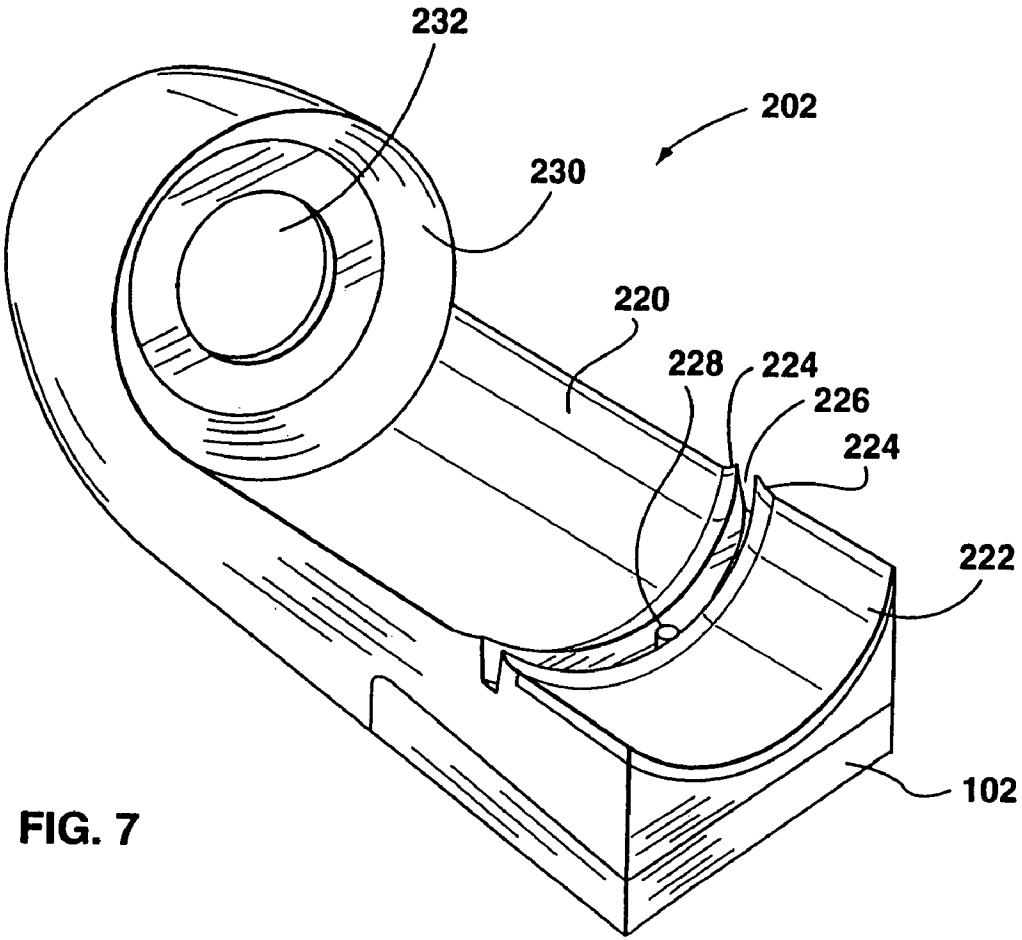
FIG. 7 is a perspective view of a base in accordance with an alternative embodiment of the present invention

Reference is made to FIGS. 6 and 7, which show a cartridge 200 and a base 202 in accordance with another preferred embodiment of the present invention. Cartridge 200 is similar to cartridge 16, except as follows. Cartridge 200 has a body 204 that is generally cylindrical about an axis 206. A member 208 extends around the circumference of body 204. A depression ring 210 extends around the circumference of body 204. An activator flange 212 extends radially outwardly from depression ring 210, and preferably does not extend radially past the outer diameter of body 204. By having a flange 212 that does not extend past the outer diameter of body 204, the flange is less prone to damage in the event that cartridge 200 is dropped. The forward end of cartridge 200 has a chamfered surface 214 that extends around the circumference of body 204.

Base 202 is similar to base 18 (FIG. 1) except as follows. Base 202 includes a generally part-cylindrically shaped cartridge mounting surface 220 that is shaped to mate with the generally cylindrical shaped body 204 of cartridge 200.

A connector for releasably connecting the cartridge 200 and base 202 together may include a magnet 222 and a member 208 that is attracted to the magnet 222. The magnet 222 may be generally part-cylindrically shaped and may be incorporated into mounting surface 220. Magnet 222 mates with a portion of member 208 on cartridge 200 to help hold cartridge 200 on base 202.

The member 208 may be a magnet itself, or it may be any material that is not magnetic but is attracted to a magnet, such as carbon steel.

The magnet 222 may be positioned on the base 202 and the member 208 may be positioned on the cartridge 200, as shown in FIGS. 6 and 7. Alternatively, however, the magnet 222 may be positioned on the cartridge 200, and the member 208 may be positioned on the base 202.

The connector may be another type of connector instead of the magnet 222 and member 208. For example, the connector may include a hook-and-loop fastener, whereby a hook portion is mounted on one of the base 202 or the cartridge 200 and the loop portion is mounted on the other of the base 208 or the cartridge 200.

For example, the member 208 may be made from a material that is a permanent magnetic, and the magnet 222 may be made from a material that is not magnetic. For example, the member 222 may be made from carbon steel, which is attracted to magnets, but is not magnetic itself when positioned away from any magnetic fields.

Mounting surface 220 also includes a pair of raised ridges 224, which define a groove 226. Inside groove 226 is an activation switch 228. Ridges 224 fit within a portion of depression ring 210 on either side of flange 212 on cartridge 200. Flange 212 is thus received in groove 226 and contacts activation switch 228, to indicate to the controller (not shown) in base 202 that cartridge 200 is present. Base 202 also includes a chamfered hood portion 230, which receives chamfered edge 214 on cartridge 200. By having chamfered hood 214 and by having chamfered forward edge 214, the mounting of cartridge 200 onto base 202 is facilitated. A hole 232 in base 202 receives gear 66 from cartridge 200, so that gear 66 can connect to the internal drive mechanism (not shown) within base 202. Battery pack 102 mounts as before to base 202.

Cartridge 200 can be mounted onto base 202, while cartridge 200 is in any circumferential orientation about axis 206, thus facilitating the mounting of cartridge 200 onto base 202.

In a preferred embodiment, activator flange 212 is recessed in depression ring 210, and does not extend past the outer diameter of body 204. Alternatively, however, body 204 may have no depression and activator flange 212 may extend from body 204, thus extending past the outer diameter of body 204.

In a preferred embodiment, delivery conduit 20 is included integrally with base 18. The loader can alternatively include a separate base and separate delivery conduit. In this alternative embodiment, the delivery conduit can mount to the inlet of a paintball marker separately, and the base can connect to the delivery conduit. Cartridges, in turn, could mount to the base, similarly to cartridges 16 and 200 and bases 18 and 202. Alternatively, the separate delivery conduit can mount to the base, and then the base/conduit assembly can mount to the inlet of a paintball marker.

Preferably, a plurality of sensors 92 are included within passageway 91. Alternatively, a single sensor may be included in passageway 91.

In a preferred embodiment, spring 40 and pressure plate 38 are used to urge paintballs 12 towards outlet 32. Alternatively, any other pressurizing means can be used to maintain a compressive force on paintballs 12 and to urge them towards outlet 32 while ensuring that the compressive force is not so large as to damage paintballs 12.

In a preferred embodiment, tube 56 rotates directly against bearing portion 49. The apparatus can alternatively have a tube, a bearing portion and a bearing, (e.g. a ball bearing) in between the tube and the bearing portion. Any other suitable bearing means can be used.

In a preferred embodiment, flow assistor 34 includes agitation surface 50 with bosses 60 and dimples 62 in order to agitate paintballs 12 and assist flow. In an alternative embodiment, the agitation surface may include only bosses 60. In another alternative, the agitation surface may include only dimples 62. Alternatively, any other suitable flow assistance means may be used.

Figure 8A:
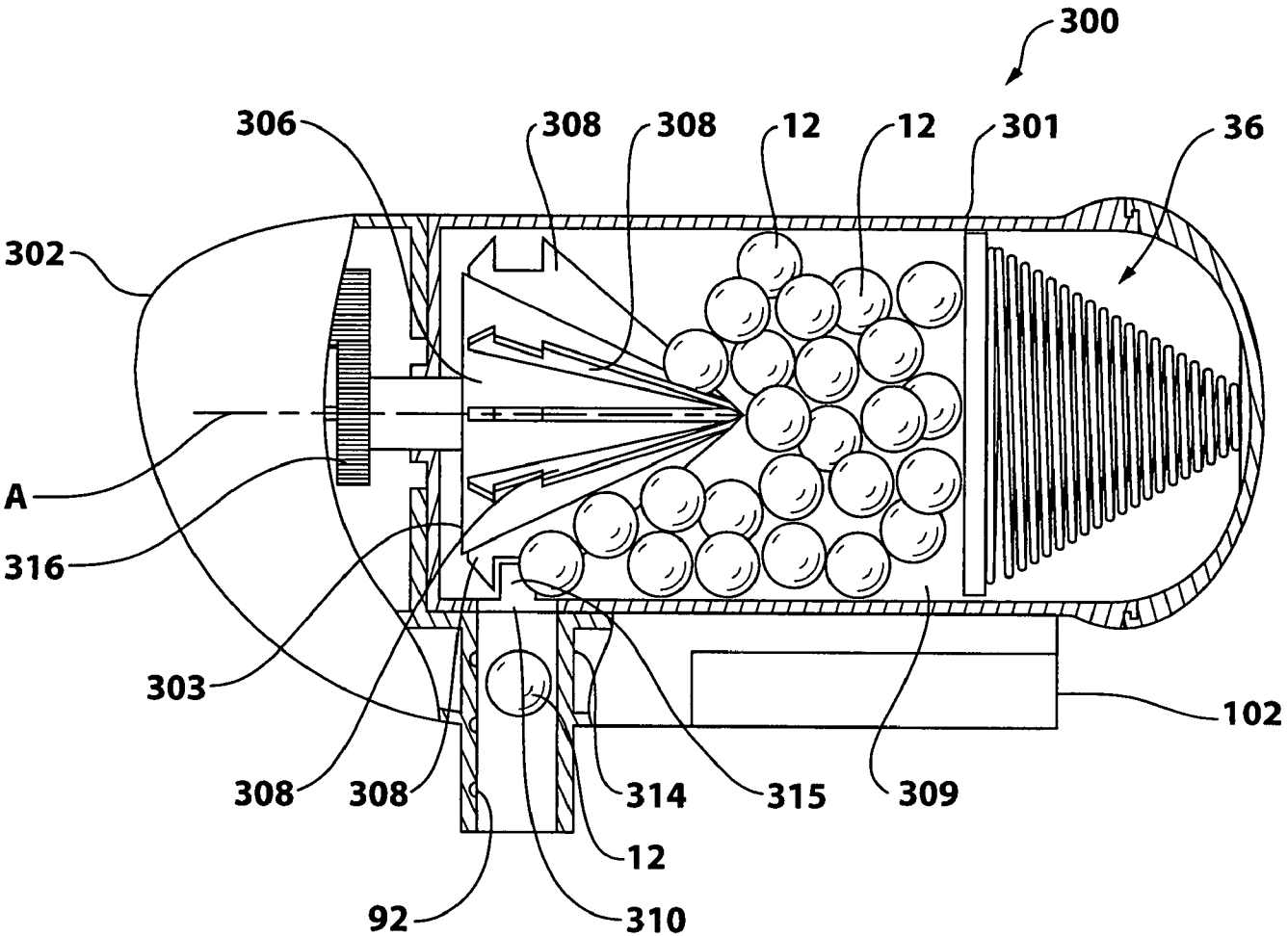
FIG. 8*a* is a sectional side view of a loader apparatus in accordance with another embodiment of the present invention.
Figure 8B:
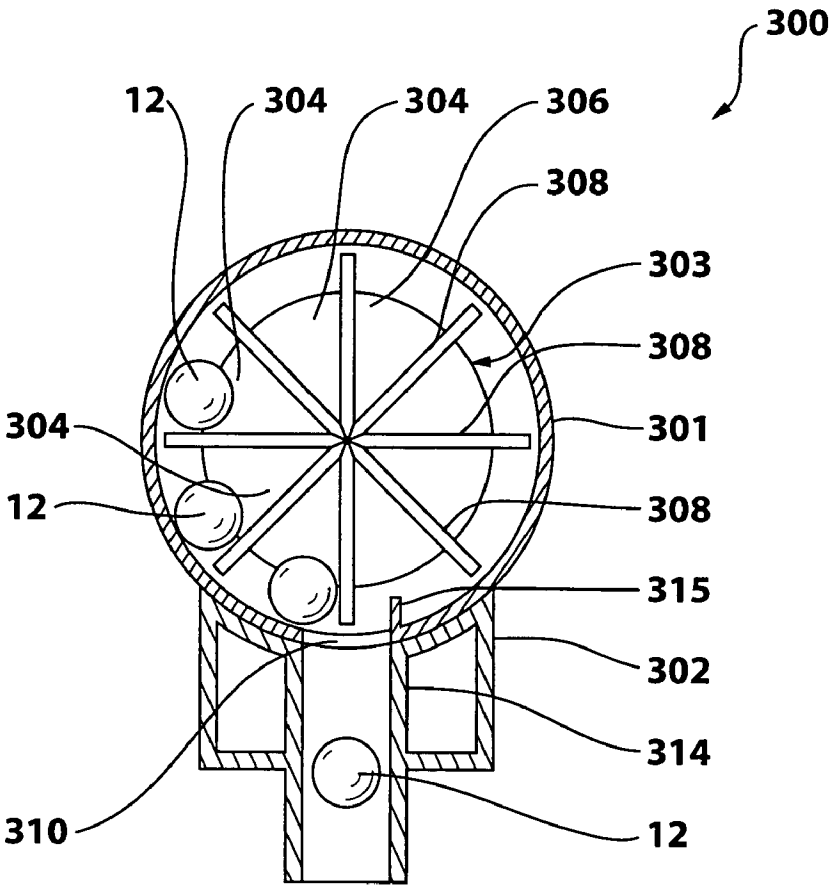
FIG. 8*b* is an end view of a flow assistor shown in FIG. 8*a;*

Reference is made to FIGS. 8*a* and 8*b*, which show a loader 300 in accordance with another embodiment of the present invention. The loader 300 includes a cartridge 301 and a base 302. The cartridge 301 may be similar to the cartridge 34 (FIG. 1) except that the cartridge 301 includes a flow assistor 303 instead of the flow assistor 34 (FIG. 1). The flow assistor 303 rotates about an axis A, and includes a plurality of paintball guide chambers 304 (see FIG. 8*b*) arranged in a polar array about the axis A.

The guide chambers 304 may be defined by a generally conical surface 306 and by radially extending fins 308. The guide chambers 304 are fed paintballs 12 from the cartridge chamber, which is shown at 309 (FIG. 8*a*) as a result the force exerted thereon by the pressurizing member 36 (FIG. 8*a*). The guide chambers 304 are each sized to retain one paintball 12.

An outlet 310 is positioned at a point along the swept surface of the flow assistor 303 on the wall of the chamber 309 (FIG. 8*a*). The outlet 310 is preferably positioned on the bottom of the chamber 309 (FIG. 8*a*) so that gravity assists in the flow of paintballs 12 through the outlet 310 when the marker 14 is in a typical orientation, which is generally level, as shown in FIG. 1.

The outlet 310 communicates with a conduit 314 in the base 302. The conduit 314 in the base 302, in turn, communicates with the inlet of the paintball marker (not shown). The conduit 314 defines a paintball flow path to the inlet of the paintball marker (not shown). The conduit 314 permits paintballs 12 to flow in a single row, and is sized to be sufficiently large in cross-sectional size to permit flow of paintballs 12 therein, but not so large as to risk jamming or wedging of two paintballs 12 against each other therein.

A fixed guide wall 315 extends into the chamber 30 from the conduit 314 to prevent paintballs 12 from passing over the outlet 310 without falling therethrough.

The generally conical surface 306 facilitates the transfer of force from the pressurizing member 36 (FIG. 8*a*) to paintballs 12 in the conduit 314. Because the surface 306 is conical, paintballs 12 are urged towards the outer perimeter of the conical surface 306, as a result of the pressure applied to the paintballs 12 from the pressurizing member 36. The force that urges the paintballs 12 towards the outer perimeter of the conical surface 306 may be broken down into a vector addition of a radial component and an axial component. A portion of the radial component of the force is transferred to the paintballs 12 in the conduits 312 and 314. The wall of the chamber 30 receives the rest of the radial component.

A gear 316 replaces the gear 66 (FIG. 1) on the cartridge 301. The gear 316 may be similar to the gear 66 except that the gear 316 lacks a paintball feed conduit therethrough, which is present on the gear 66 of FIG. 1. The gear 66 may be driven by the pinion gear 88 in the base 302. The pinion gear 88 is operatively connected to a motive means (not shown) in the base 302. Aside from the position of the paintball feed conduit 314, the base 302 may be similar to the base 18 (FIG. 1).

Figure 9A:
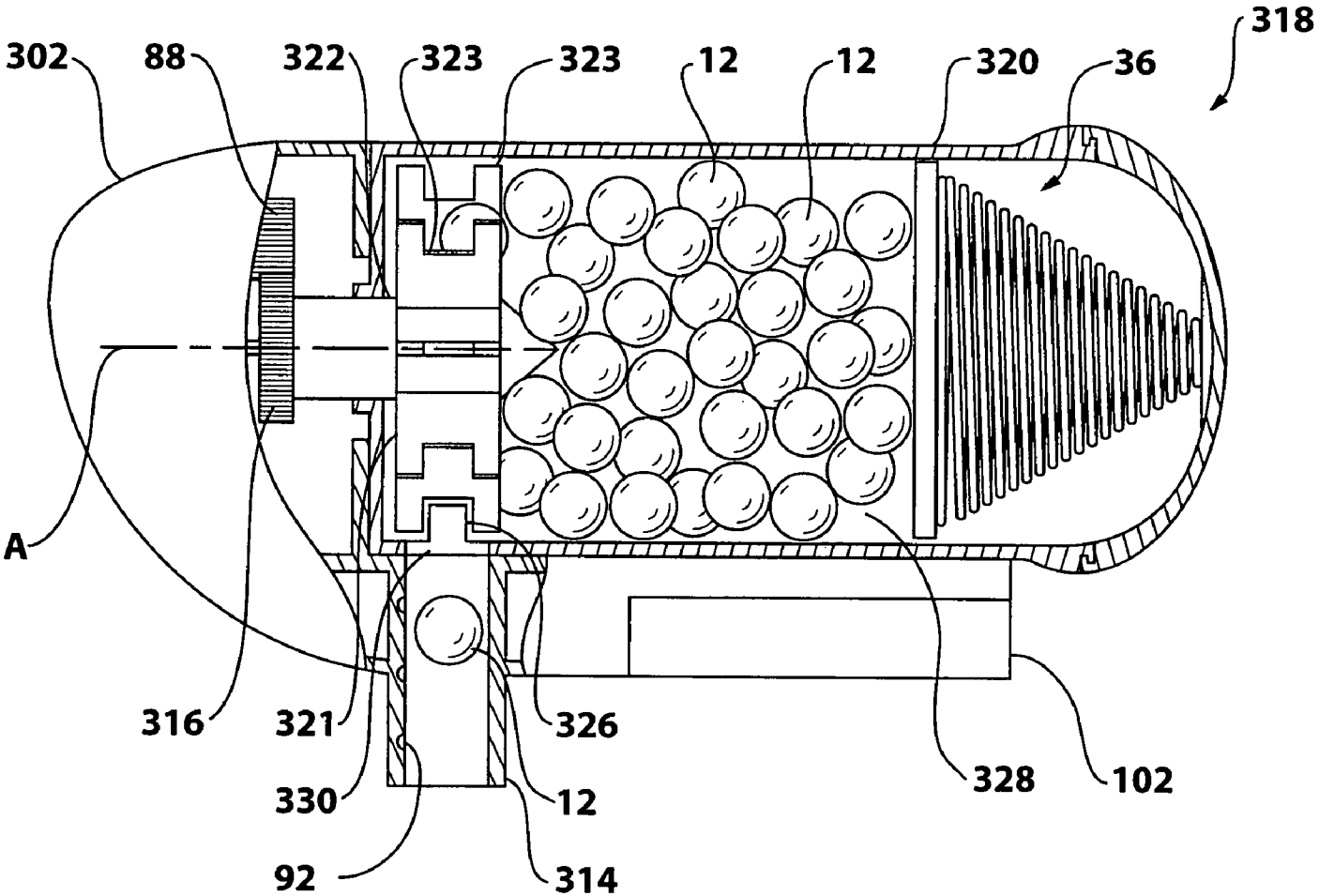
FIG. 9*a* is a sectional side view of a loader apparatus in accordance with yet another embodiment of the present invention.
Figure 9B:
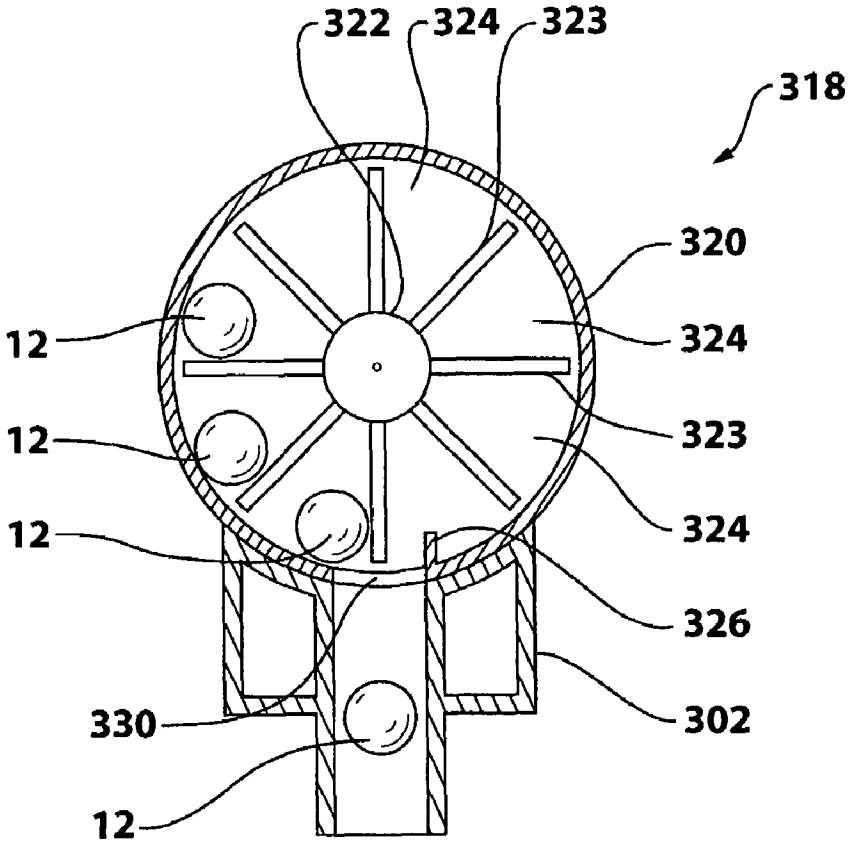
FIG. 9*b* is an end view of a flow assistor shown in FIG. 9*a;*

Reference is made to FIGS. 9*a* and 9*b*, which show a loader 318 which has the base 302 and a cartridge 320. The cartridge 320 may be similar to the cartridge 301 (FIGS. 8*a* and 8*b*), except that the cartridge 320 has a flow assistor 321 which is a variation of the flow assistor 303 (FIGS. 8*a* and 8*b*). The flow assistor 321 includes a shaft 322, which is generally cylindrical and which connects to the gear 316 for rotation therewith. The shaft 322 has a plurality of fins 323 thereon which form chambers 324 (see FIG. 9*b*) for retaining paintballs 12 during the rotation of the shaft 322. Th fins 323 are notched to clear a fixed guide wall 326 which extends into the cartridge chamber, which is shown at 328 (FIG. 9*a*). Th fins 323 cooperate with the fixed guide wall 326 to guide paintballs 12 out of the outlet, shown at 330.

The end of the shaft 322 that is present in the cartridge chamber 328 may be coned, to guide the paintballs 12 into the chambers 324.

Figure 10A:
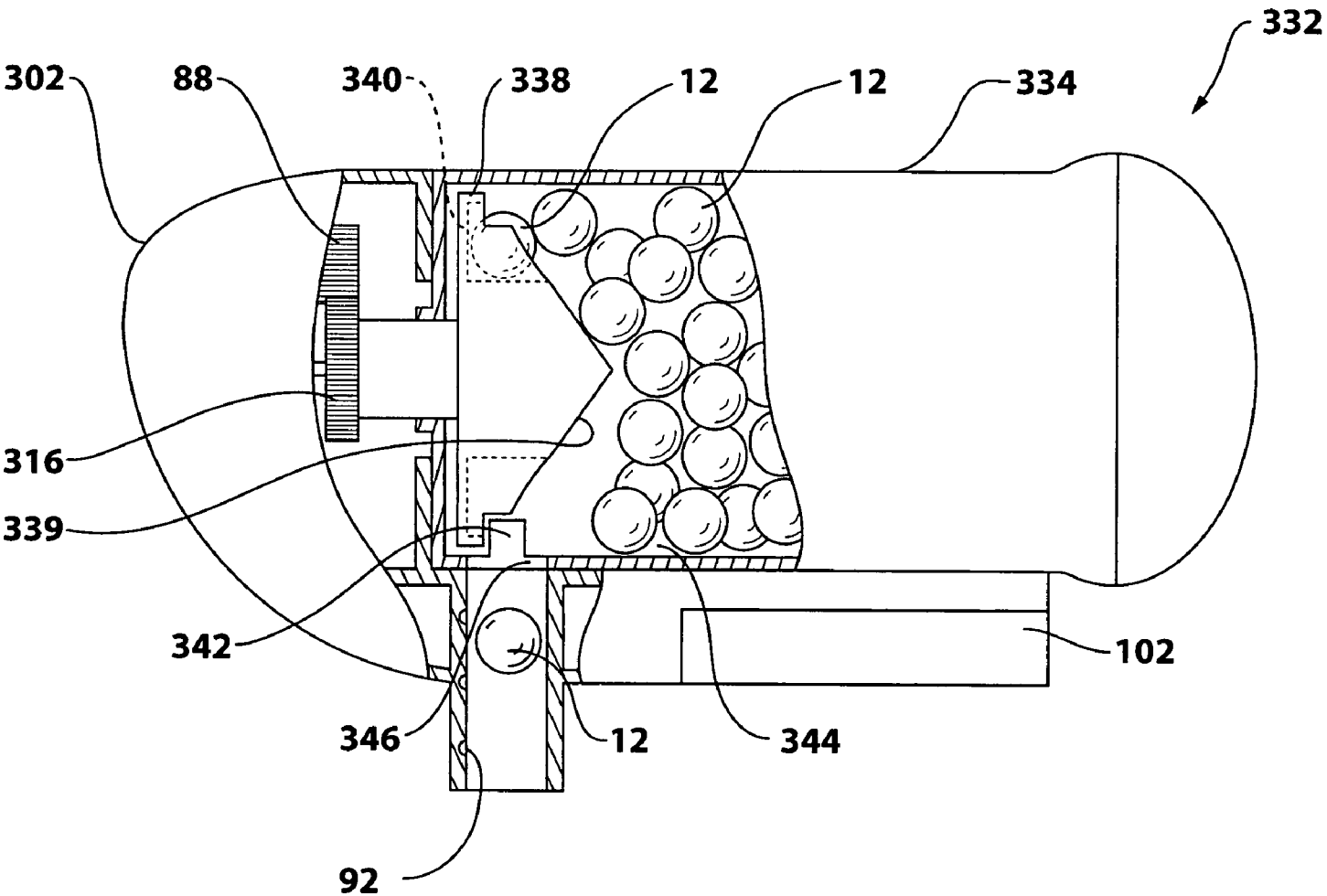
FIG. 10*a* is a sectional side view of a loader apparatus in accordance with yet another embodiment of the present invention.
Figure 10B:
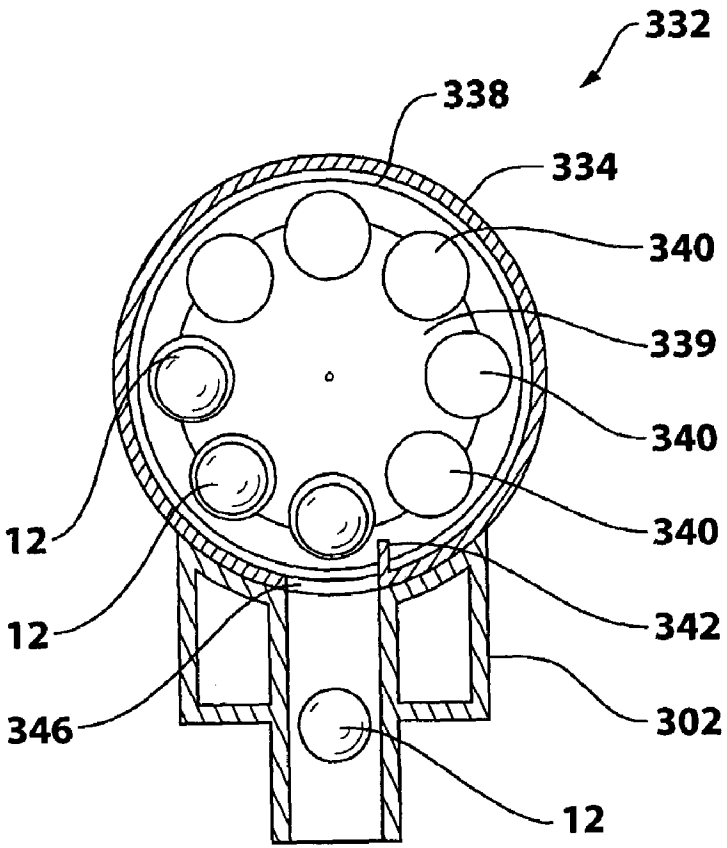
FIG. 10*b* is an end view of a flow assistor shown in FIG. 10*a;*

Reference is made to FIGS. 10*a* and 10*b*, which show a loader 332 which has the base 302 and a cartridge 334. The cartridge 334 may be similar to the cartridge 301 (FIGS. 8*a* and 8*b*), except that the cartridge 334 has a flow assistor 338 instead of the flow assistor 303 (FIGS. 8*a* and 8*b*). The flow assistor 338 may have a cone shaped portion 339 which has a plurality of chambers 340 (FIG. 10*b*) defined directly therein, instead of being defined by fins (see FIGS. 8*a*, 8*b*, 9*a* and 9*b*). The chambers 340 (FIG. 10*b*) may have any suitable shape for retaining a paintball 12. The chambers 340 are provided with clearance to clear a fixed guide wall 342 which extends into the cartridge chamber, which is shown at 344 (FIG. 10*a*). The cone shaped portion 339 cooperates with the fixed guide wall 342 to guide paintballs 12 out of the outlet, shown at 346.

The flow assistor 338 connects to the gear 316 for rotation therewith.

In the embodiments described above and shown in FIGS. 8*a*, 8*b*, 9*a*, 9*b*, 10*a* and 10*b*, wherein a fixed guide wall extends into the chamber 30, the fixed guide wall may be made flexible and resilient so that breakage of paintballs 12 is inhibited during rotation of the flow assistor. The fixed guide wall has been described as being integral with the cartridge. It is alternatively possible for the fixed guide wall to the integral with the base 302.

The driven means 72 may further include an optional slippage mechanism 89 therein (see FIG. 1). The slippage mechanism 89 may be configured so that slip is prevented when the paintballs 12 flow in the normal fashion during rotation of the flow assistor 34, and slip is permitted when there is a paintball jam if one should occur during rotation of the flow assistor. The slippage mechanism 89 may be incorporated for use with any of the flow assistors described herein. Th slippage mechanism 89 may, for example, be incorporated on the output shaft of the motor 70 between the motor 70 and the pulley 80.

In an alternative embodiment, the loader apparatus includes a cartridge and base, the cartridge having paintball chamber 30 and flow assistor 34 mounted therein, the flow assistor being driven by a motor, similar to the embodiment shown in FIG. 1. In this alternative embodiment however, the cartridge may be fixed permanently to the base, or may be removable therefrom.

In an alternative embodiment, not shown, cartridge flow preventer 130 comprises spring plungers, (eg. ball plungers), spaced circumferentially around surface 68, instead of arms 132 and recesses 136. The plungers would extend radially inwards in outlet 32 to prevent paintballs 12 from spilling out of outlet 32, when the cartridge is not mounted to the base. The plungers would be compressed out of the way by passageway inlet 137, when the cartridge is mounted to the base, so that the plungers would not inhibit the flow of paintballs. As another alternative, cartridge flow preventer 130 can comprise resilient, flexible wires that would be shaped substantially as a mirror image to flow preventer 131. Such wires would preferably have a slope surface similar to surface 138, so that they would be pushed radially out of the way by inlet 137 when the cartridge is mounted to the base.

In a preferred embodiment, magnets hold the cartridge on the base. Alternatively, a single magnet and a ferrous metallic plate could be used or a magnet and any other material that is attracted magnetically to a magnet can alternatively be used. Alternatively, another retaining structure may be used, such as a hook and loop fabric material (Velcro TM). Similarly, a magnet and a ferrous metallic plate, or a hook and loop fabric material can alternatively be used to hold the battery pack to the base.

The term 'electrical conduit' has been used to denote an electrical connection between several components, such as between sensors 92 and the controller 74, and between the on/off switch 112 and the controller 74. The electrical conduits that are used may be, for example, an electrically conductive wire, or they may be an electrical conduit on a hard circuit board, or an electrical conduit on a flexible circuit board.

In a preferred embodiment, the driven means include pulleys, a belt, and meshing gears between motive means 70 and flow assistor 34. Alternatively, different driven means may be incorporated, such as a magnetic drive, or simply two gears.

In a preferred embodiment, the loader 10 is removable from the inlet 22 of the marker 14. In an alternative embodiment, a marker (not shown) may have a delivery conduit that is permanently connected to the inlet of the body of the marker. The permanent connection may be as a result of the base 18 being integral with the marker inlet. Instead of being integrally formed with the marker inlet, the delivery conduit from the loader could be permanently mounted to the marker inlet by means of an adhesive or one or more fasteners, such as screws.

In a preferred embodiment, the battery pack 102 is removable from the loader 10 for replacement and for recharging in embodiments incorporating rechargeable batteries 105. It is alternatively possible, however for the battery pack to remain fixed in the loader.

As another alternative that is not shown, the battery pack 102 may be fixedly attached to the cartridge 16. As such, if either the batteries 105 run out of power, or the cartridge runs out of paintballs 12, then the cartridge 16 may be removed and replaced quickly, so that a new cartridge 16 and a fresh battery pack 102 are provided at the same time. In this case, the cartridge 16 would include electrical contacts which contact electrical contacts in the base to connect the battery pack 102 to the controller 74 and motive means 72. In this case, the battery pack 102 may be removable from the cartridge 16 for recharging or may alternatively be fixed in the cartridge 16 and may be recharged while remaining within the cartridge 16.

In a preferred embodiment, the loader 10 includes a battery pack 102 that mounts to the base 18. It is alternatively possible for the battery pack 102 to be omitted from the loader 10. For example, the motive means for the flow assistor 34 may be a spring, which would not require a battery pack 102. As another example, the loader 10 may alternatively be electrically connected to the battery of the marker 14 itself (not shown). The marker may include a battery where there are electrical or electronic components operating therein.

In a preferred embodiment, the cartridge 16, 200 mounts above the base 18, 202. In an alternative embodiment, the cartridge 16, 200 may mount in any suitable orientation relative to the base 18, 202. For example, the cartridge 16, 200 may mount on the side of the base 18, 202 or under the base 18, 202. Furthermore, the base 18, 202 and cartridge 16, 200 may together mount underneath the barrel of the marker 14, shown at 500 in FIG. 1. By mounting the base 18, 202 and cartridge 16, 200 underneath the barrel 500, the weight distribution of the assembly of the marker 14 and the loader 10 is lowered so that the assembly is less top heavy than with an embodiment whereby the loader 10 mounts above the marker 14. The delivery conduit 20 in any case remains in communication with the inlet 22 of the marker 14, which is typically on top of the marker 14. The delivery conduit 20 can be made flexible to accomplish the task of connecting the outlet 32 of the chamber 30 with the paintball inlet 22 of the marker 14.

It has been described to provide a mechanism to inhibit paintballs from spilling out of the outlet 32 of the chamber 30 when the cartridge is not mounted on the base. It is alternatively possible to include a closure (not shown) for the outlet 32 which can be opened either manually or automatically upon installation of the cartridge on the base. The closure acts to prevent debris from entering the chamber 30 when the cartridge is not mounted on the base.

The housings and some components of the base and cartridge have been described as being made of a suitable plastic. It is alternatively possible for the housings in particular and the delivery conduit to be made from a suitable metal that is preferably lightweight.

In the embodiments described, a base has been included to which the cartridge mounts removably. It is alternatively possible to have the cartridge mount to any structure so that it is in flow communication with the paintball inlet of the marker 14. As such, any structure to which the cartridge mounts removably is effectively a base in the sense that that term is meant herein.

Providing a paintball loader apparatus with a pressurizing member to push the paintballs towards the outlet of the loader, reduces unwanted noise from the paintballs contained therein, and further allows the paintball marker to be fired while in any orientation. Furthermore, providing the apparatus with a base and a quickly removable cartridge provides the user with the utility of a quick, inexpensive way of refitting the marker with a fresh paintball supply, while maintaining the advantages inherent in a motorized discharging means. Furthermore, providing a quickly removable battery pack provides the user with the ability to quickly replace the battery pack to continue game play.

As will be apparent to persons skilled in the art, various modifications and adaptations of the apparatus described above may be made without departure from the present invention, the scope of which is defined in the appended claims.

The invention claimed is:

1. A loader apparatus for use with a paintball marker, the loader apparatus comprising:

a cartridge, said cartridge including a chamber for paintballs, said chamber having a paintball outlet, said cartridge further including a flow assistor, said flow assistor having a generally funnel-shaped surface, wherein said flow assistor is rotatable, wherein said surface includes irregularities for inhibiting jams in a flow of paintballs towards said paintball outlet during rotation of said flow assistor.

2. A loader apparatus as claimed in claim 1, further comprising a base, and said cartridge is removably connectable to said base.

3. A loader apparatus as claimed in claim 2, wherein said base further comprises a first mating surface, and said cartridge further comprises a second mating surface, which contacts said first mating surface when said cartridge is mounted on said base, and said apparatus further comprises a connector for releasably holding said first and second mating surfaces together.

4. A loader apparatus as claimed in claim 3, wherein said connector comprises a magnet, and a material that is magnetically attracted to said magnet.

5. A loader apparatus as claimed in claim 2, further comprising a motor, wherein the flow assistor is rotatable by said motor, and wherein said motor is positioned in said base.

6. A loader apparatus as claimed in claim 2, wherein the loader apparatus further comprises a motor, wherein the flow assistor is rotatable by said motor, and wherein the loader apparatus further comprises a first driven means positioned in said base, wherein said motor is operatively connected to said first driven means, and further comprising a second driven means operatively connected to said flow assistor, wherein said first driven means is operatively connected to said second driven means when said cartridge is mounted to said base.

7. A loader apparatus as claimed in claim 1, wherein said loader apparatus further comprises a pressurizing member for maintaining a force on said paintballs in said chamber to urge said paintballs towards said paintball outlet.

8. A loader apparatus as claimed in claim 7, wherein said pressurizing member comprises a spring, said spring being operatively connected to said paintballs, so that said spring is adapted to act on said paintballs to urge said paintballs towards said paintball outlet.

9. A loader apparatus as claimed in claim 1, wherein said loader apparatus further comprises a motor, wherein the flow assistor is rotatable by said motor, and wherein said loader apparatus further comprises a delivery conduit, wherein said delivery conduit is positioned for communication of paintballs from said paintball outlet of said chamber to a paintball inlet of said paintball marker, wherein said delivery conduit comprises at least one paintball sensor for detecting the presence of paintballs in said delivery conduit, said at least one sensor is operatively connected to said motor so that said sensor sends a signal to activate said motor when said sensor does not detect the presence of a paintball.

10. A loader apparatus as claimed in claim 9, further comprising retractable stops positioned in said paintball outlet, wherein said stops are retractable from said paintball outlet to allow the passage of paintballs by attachment of said cartridge to said base, and said stops are biased to extend into said outlet to prevent the passage of paintballs when said cartridge is unattached from said base.

11. A loader apparatus as claimed in claim 1, wherein said surface comprises a plurality of bosses.

12. A loader apparatus as claimed in claim 1, wherein said surface comprises a plurality of dimples.

13. A loader apparatus as claimed in claim 1, wherein said surface comprises a plurality of bosses and dimples.

14. A loader apparatus for use with a paintball marker having a paintball inlet, the loader apparatus comprising:

a) a cartridge including a chamber for paintballs, said chamber having a paintball outlet;

b) a base for connecting said cartridge to said paintball inlet for enabling passage of paintballs from said chamber to said paintball inlet;

c) a driven flow assistor for inhibiting jams in a flow of paintballs towards said paintball inlet; and d) a motive means for driving said flow assistor, wherein said motive means is operatively connectable to said flow assistor, wherein said motive means is mounted to one of said base and said marker, so that said motive means is separate from said cartridge.

15. A loader apparatus as claimed in claim 14, wherein said flow assistor is positioned at least partially in said chamber.

16. A loader apparatus as claimed in claim 14, wherein said loader apparatus further comprises a pressurizing member for maintaining a force on said paintballs in said chamber to urge said paintballs towards said paintball outlet.

17. A loader apparatus as claimed in claim 16, wherein said pressurizing member comprises a spring, said spring being operatively connected to said paintballs, so that said spring is adapted to act on said paintballs to force said paintballs towards said paintball outlet.

18. A loader apparatus as claimed in claim 14, wherein said flow assistor comprises a generally funnel-shaped surface surrounding said paintball outlet, said generally funnel-shaped surface comprising surface irregularities for agitating paintballs.

19. A loader apparatus as claimed in claim 14, wherein said base has a first mating surface, and said cartridge has a second mating surface, which contacts said first mating surface when said cartridge is mounted on said base, and said loader apparatus further comprises a connector for releasably holding said first and second mating surfaces together.

20. A loader apparatus as claimed in claim 19, wherein said connector comprises a magnet, and a material that is magnetically attracted to said magnet.

21. A loader apparatus as claimed in claim 20, wherein said delivery conduit comprises at least one paintball sensor for detecting the presence of paintballs in said flow conduit, said at least one sensor is operatively connected to said motive means so that said sensor activates said motive means when said sensor does not detect the presence of a paintball.

22. A loader apparatus as claimed in claim 21, wherein said paintball outlet comprises retractable stops positioned in said paintball outlet, said stops being adapted to retract from said paintball outlet to allow the passage of paintballs when said cartridge is attached to said base, and said stops being adapted to extend into said outlet to prevent the passage of paintballs when said cartridge is unattached from said base.

23. A loader apparatus as claimed in claim 14, wherein said motive means is positioned in said base.

24. A loader apparatus as claimed in claim 14, wherein said motive means includes an electric motor positioned in said base.

25. A loader apparatus as claimed in claim 14, wherein said base is integrally connected to said paintball marker.

26. A loader apparatus for use with a paintball marker having a paintball inlet, the loader apparatus comprising:

a cartridge, and a motive means, said cartridge including a chamber for paintballs, said chamber having a paintball outlet, said cartridge further including a flow assistor, wherein said cartridge is removably connectable with respect to said paintball marker for communication of paintballs from said paintball outlet of said chamber to said paintball inlet, wherein, when said cartridge is connected with respect to said paintball marker, said motive means is operatively connectable to said flow assistor for driving said flow assistor, and wherein said loader apparatus further comprises a pressurizing member for maintaining a force on said paintballs in said chamber to urge said paintballs towards said paintball outlet.

27. A loader apparatus for use with a paintball marker having a paintball inlet, the loader apparatus comprising:

a cartridge, and a motive means, said cartridge including a chamber for paintballs, said chamber having a paintball outlet, said cartridge further including a flow assistor, wherein said cartridge is removably connectable with respect to said paintball marker for communication of paintballs from said paintball outlet of said chamber to said paintball inlet, wherein, when said cartridge is connected with respect to said paintball marker, said motive means is operatively connectable to said flow assistor for driving said flow assistor, and wherein said flow assistor comprises a generally funnel-shaped surface surrounding said paintball outlet, said generally funnel-shaped surface comprising surface irregularities for agitating paintballs.

28. A loader apparatus for use with a paintball marker having a paintball inlet, the loader apparatus comprising:

a cartridge, wherein said cartridge includes a chamber for paintballs, said chamber defining a paintball outlet, wherein said cartridge is positionable for communication of paintballs from said paintball outlet of said chamber to said paintball inlet of said paintball marker, and a pressurizing member for maintaining a force on said paintballs in said chamber to urge said paintballs in said chamber towards said paintball outlet, wherein said pressurizing member is adapted to contact a plurality of paintballs simultaneously, wherein said loader further comprises a base, wherein said cartridge is removably attachable to said base, and wherein said cartridge includes a flow assistor and said loader apparatus further includes a motive means operatively connectable to said flow assistor when said cartridge is attached to said base.

29. A loader apparatus for use with a paintball marker having a paintball inlet, the loader apparatus comprising:

a cartridge, wherein said cartridge includes a chamber for paintballs, said chamber defining a paintball outlet, wherein said cartridge is positionable for communication of paintballs from said paintball outlet of said chamber to said paintball inlet of said paintball marker, and a pressurizing member for maintaining a force on said paintballs in said chamber to urge said paintballs in said chamber towards said paintball outlet, wherein said pressurizing member is adapted to contact a plurality of paintballs simultaneously, wherein said pressurizing member comprises a spring, wherein said spring is operatively connected to said paintballs, so that said spring is adapted to act on said paintballs to urge said paintballs towards said paintball outlet.

30. A loader apparatus for use with a paintball marker, the loader apparatus comprising:

a cartridge, said cartridge including a chamber for paintballs, said chamber having a paintball outlet, said cartridge further including a flow assistor, said flow assistor having a paintball contact surface, wherein said flow assistor is rotatable, wherein said surface has a large diameter end and a small diameter end, wherein said small diameter end is downstream from said large diameter end, wherein said surface generally tapers from said large diameter end to said small diameter end, and wherein said surface includes irregularities for inhibiting jams in a flow of paintballs towards said paintball outlet during rotation of said flow assistor.

31. A loader apparatus as claimed in claim 30, further comprising a base, and said cartridge is removably connectable to said base.

32. A loader apparatus as claimed in claim 30, wherein said surface comprises a plurality of bosses.

33. A loader apparatus as claimed in claim 30, wherein said surface comprises a plurality of dimples.

34. A loader apparatus as claimed in claim 30, wherein said surface comprises a plurality of bosses and dimples.

35. A loader apparatus for use with a paintball marker having a paintball inlet, the loader apparatus comprising:

a) a cartridge including a chamber for paintballs, said chamber having a paintball outlet;

b) a base for connecting said cartridge to said paintball inlet for enabling passage of paintballs from said chamber to said paintball inlet, wherein said cartridge is removably connectable to said base;

c) a driven flow assistor for inhibiting jams in a flow of paintballs towards said paintball inlet; and d) a motor, wherein said base includes said motor, wherein said motor is operatively connectable to said flow assistor.

* * * * *